US005401016A

United States Patent [19]

Heglund et al.

[11] Patent Number: 5,401,016

[45] Date of Patent: Mar. 28, 1995

[54] AUTOMATIC BASEBALL BALL AND STRIKE INDICATOR

[76] Inventors: Kenneth W. Heglund, 2552 Crooked Creek, Apt. 307, Schaumburg, Ill. 60173; Michael P. O'Dierno, 2217 SE. 156th, Portland, Oreg. 97233; Travis Scheckel, 6625 Shadybrook La., Apt. 3224, Dallas, Tex. 75206

[21] Appl. No.: 62,986

[22] Filed: May 18, 1993

[51] Int. Cl.[6] ..... A63B 71/02

[52] U.S. Cl. ..... 273/25

[58] Field of Search ..... 273/25

[56] References Cited

U.S. PATENT DOCUMENTS

| | | | |
|---|---|---|---|
| 311,278 | 1/1885 | Williams | 273/25 |
| 727,633 | 5/1903 | Humphreys | 273/25 |
| 1,066,773 | 7/1913 | Wills | 273/25 |
| 1,768,207 | 6/1930 | Lumpkin et al. | 273/25 |
| 1,868,088 | 7/1932 | Blair | 273/25 |
| 2,121,742 | 6/1938 | McLaughlin | 273/25 |
| 2,440,042 | 4/1948 | Friedman | 273/25 |
| 2,647,032 | 7/1953 | Holiday et al. | 273/25 |
| 3,341,199 | 9/1967 | Madsen | 273/25 |
| 4,545,576 | 10/1985 | Harris | 273/25 |
| 4,941,662 | 7/1990 | DePerna | 273/25 |
| 4,972,171 | 11/1990 | Johnson et al. | 340/323 |
| 4,999,603 | 3/1991 | Mele et al. | 340/323 |
| 5,069,450 | 12/1991 | Pyle | 273/25 |

*Primary Examiner*—Theatrice Brown

*Attorney, Agent, or Firm*—Andrus, Sceales, Starke & Sawall

[57] ABSTRACT

The self-contained ball-strike detector uses two transducers to detect the presence of an incoming pitch, and a series of transducers located on the upper surface of a home plate-shaped housing to determine whether the pitched ball is within the strike zone. Ultrasonic transducers are located near both the right and left boundaries of the strike zone. These transducers and a centrally-located transducer emit high frequency signals in the direction of the pitched ball. A reflected signal is used to determine whether the pitched ball is within the strike zone. The size of the strike zone may be changed to accommodate batters of different heights. The apparatus includes audio and visual indicators of whether the pitch is a "ball" or a "strike" as well as indicators if the batter is "out" or is entitled to a "walk". The apparatus maintains the ball/strike count for each batter, and has light emitting diodes to visually indicate the current count for the batter.

28 Claims, 24 Drawing Sheets

AUTOMATIC BASEBALL BALL AND STRIKE INDICATOR

BACKGROUND OF THE INVENTION

This invention relates to electronic devices used in sporting-type games. More particularly, this invention relates to electronic devices used in baseball games.

In the game of baseball, incoming pitches are directed towards an imaginary strike zone that is adjacent to the batter's box where the batter stands. A pitched ball which passes through at least a portion of the strike zone is called a "strike", regardless of whether the batter swings the bat at the pitched ball. A batter is allowed a predetermined number of strikes before he is called "out". Any pitch that does not pass through a portion of the strike zone and is not swung at by the batter is called a "ball". If the batter receives a predetermined number of "balls", he progresses or "walks" to first base.

Although there are several definitions of the term "strike zone", for purposes of this application, a "strike zone" is an imaginary area that is located above the home plate. The strike zone is defined by right, left, upper and lower boundaries. The right and left boundaries are imaginary vertical planes that extend upward from the right and left sides of the home plate. The lengths of the vertical sides depend upon the height of the batter. In general, the upper boundary of the strike zone is a plane aligned with the armpits of the batter, and the bottom or lower boundary is a plane aligned with the knees of the batter. Since batters have different heights, it is apparent that the upper and lower boundaries of the strike zone vary from batter to batter.

A human umpire is typically required to determine whether the pitched balls are "balls" or "strikes". There are several disadvantages of having a human umpire calling balls and strikes. One disadvantage is the expense involved in paying the umpire to perform his duties. In not-for-profit baseball leagues, it is often difficult to adequately pay the umpires. Umpires must then be found to volunteer their time to umpire a baseball game. In some baseball leagues, for example, the expense of obtaining an umpire is prohibitive so that no umpire is used. In that event, the baseball teams are required to decide between themselves whether a particular pitch is a "ball" or a "strike". Disagreements as to the call of a particular pitch are inevitable in such cases.

Another disadvantage of using human umpires is that they make mistakes. No human umpire is capable of total accuracy in determining whether an incoming pitched ball passes through a portion of the strike zone. Also, there is a great deal of variation in the way different human umpires call balls and strikes. Some umpires use a so-called "small" strike zone because they tend to narrowly define the imaginary boundaries of the strike zone. Other umpires use a so-called "large" strike zone, or call pitches very erratically. In any case, it is apparent that there are many disadvantages whenever a human being must be used to call balls and strikes.

Several attempts have been made to devise electronic systems to avoid the need for human umpires. For example, U.S. Pat. No. 5,069,450 to Pyle is an automatic umpire for slow pitch softball which detects the impact of the pitch on a surface placed behind the baseball home plate. Any pitch which hits the surface is considered a "strike". The Pyle apparatus is obviously limited to use in slow pitch softball games in which the parties agree in advance that a strike is any pitch which hits the indicated surface.

U.S. Pat. No. 4,941,662 to DePerna discloses a sophisticated, electronic baseball game that includes a pitch detection mechanism. However, the pitch detection mechanism requires a pair of substantially spaced sensors, one near the playing surface and one on the ceiling. These and other sensors must be electrically connected together in an elaborate system to detect whether a pitched ball is within the strike zone. The system in DePerna is very complicated and expensive, and probably cost prohibitive for most applications.

SUMMARY OF THE INVENTION

A self-contained apparatus is disclosed that determines whether a pitched ball passes through at least a portion of a baseball strike zone. The apparatus also includes audible and visual indicators which inform the users whether a pitched ball is a "ball" or a "strike", the current ball/strike count for the batter, and when the batter has struck out.

In a preferred embodiment, the ball-strike detector includes a means for detecting whether a ball is approaching the strike zone, a first means for determining whether the ball is between the right and left boundaries of the strike zone, a second means for determining whether the ball is between the upper and lower boundaries of the strike zone, and an indicator means for indicating whether the ball has passed through a portion of the strike zone. The ball-strike detector also includes a housing that encloses or is mechanically interconnected with the detecting means, with the first determining means, with the second determining means, and with the indicator means. The apparatus is a self-contained unit that does not require wires or components located outside of the housing. The housing preferably replaces, and is shaped like, a baseball home plate.

In a preferred embodiment, the apparatus also includes a means for initially setting the upper and lower boundaries of the strike zone, and a means for thereafter changing the boundaries of the strike zone.

In a preferred embodiment, the detecting means includes two ultrasonic transducers disposed on the front surface of the home plate facing the direction of the expected incoming pitch.

The first determining means and the second determining means include a plurality of ultrasonic transducers disposed on the upper surface of the housing. One of these transducers is disposed near the right boundary of the strike zone, a second transducer is disposed near the left boundary of the strike zone, and a third transducer is disposed between the right and left transducers.

Each of the transducers emits a high frequency signal that is reflected by an object such as an incoming pitched ball. The time between the emission of the signal and the receipt of the reflected signal is used by the apparatus to determine the position of the object, and to determine whether the object is within the strike zone.

The apparatus includes light emitting diodes (LEDs) which indicate the number of strikes that have been pitched, the number of balls that have been pitched, and whether the most recent pitch is a ball or a strike. The apparatus may also include means for generating audible indications of whether the pitch is a "ball", a "strike", or whether the batter is "out". The ball/strike count may be manually changed by pressing one or more foot buttons disposed on the upper surface of the housing.

The means for changing the strike zone boundaries includes means for storing values corresponding to the distance between a transducer and an object disposed near the lower boundary, as well as a means for storing a distance value corresponding to the distance between the transducer and an object disposed near the new upper boundary. When an incoming ball is detected, the apparatus determines whether the distance between a transducer and the ball is between these two stored distance values.

It is a feature and advantage of the present invention to provide an economical, self-contained baseball ball-strike indicator.

It is yet another feature and advantage of the present invention to provide a ball-strike indicator whose strike zone may be varied depending upon the height of the batter.

It is yet another feature and advantage of the present invention to provide a ball-strike indicator that reliably and accurately determines whether a pitched ball is within the strike zone.

These and other features of the present invention will be apparent to those skilled in the art from the following detailed description of the preferred embodiment, and the attached drawings, in which:

DETAILED DESCRIPTION OF THE PREFERRED EMBODIMENT

Figure 1:
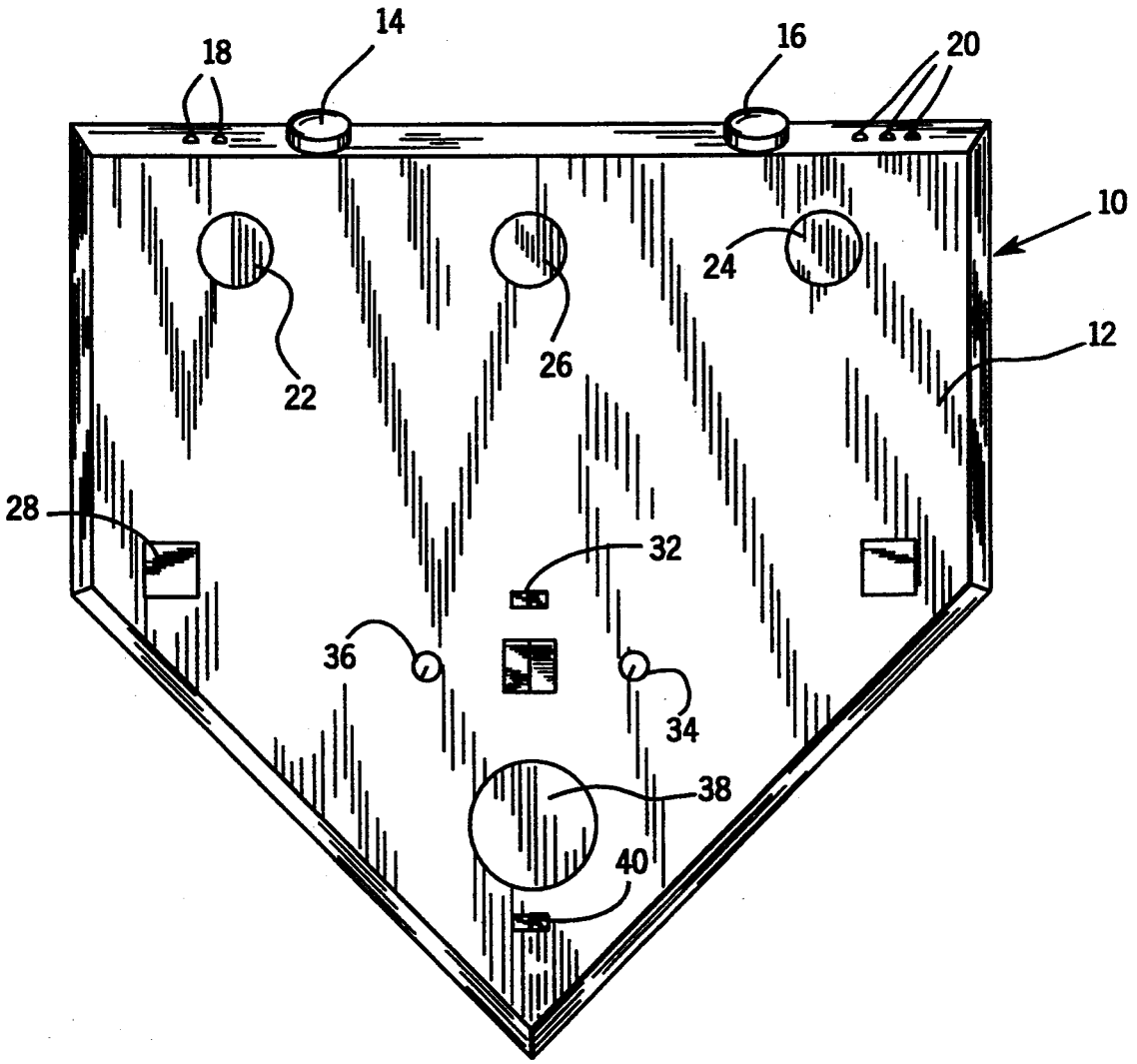
FIG. 1 is a plan view of the baseball ball-strike indicator according to the present invention.

FIG. 1 is a plan view of the self-contained ball-strike indicator according to the present invention. In FIG. 1, ball/strike indicator 10 includes a housing 12. All of the components of indicator 10 are either enclosed in housing 12 or interconnected therewith. More particularly, the circuitry described below is enclosed within housing 12. The input transducers, the output devices, and the various switches all extend from a surface of housing 12.

In FIG. 1, a pair of forward-facing "horizontal" ultrasonic transducers 14 and 16 detect the presence of an incoming, pitched ball. A pair of light emitting diodes 18 (LEDs) are output devices which indicate to the pitcher or the fielders the number of strikes in the current ball/strike count on the batter. Similarly, LEDs 20 indicate the number of "balls" in the current ball/strike count.

Disposed in the top of housing 12 are a vertical transducer 22, a vertical transducer 24, and a centrally-located vertical transducer 26. All of transducers 22 through 26 are used to determine the vertical distance of an incoming, pitched ball from indicator 10. Transducer 22 senses the position of a pitched ball on the left hand side of the plate, so that the indicator 10 may determine whether the pitched ball is within the left boundary of the strike zone.

Similarly, transducer 24 emits an ultrasonic signal which, when reflected off an incoming pitched ball or other object, determines whether the object is within the right hand boundary of the strike zone. Transducer 26 is used exclusively the vertical height of an object or a pitched ball. Transducers 22, 24 and 26 are all used to change the strike zone in the vertical direction, depending on the height of the batter. Transducers 22 through 26 are used to initially set or change the lower boundary of the strike zone as well as the upper boundary of the strike zone, as discussed below. Infrared sensors could be used to perform at least one of the functions of transducers 22, 24 and 26.

Also interconnected with the upper surface of housing 12 are a pair of foot buttons 28 and 30. Each foot button may be pressed to adjust the ball/strike count in the event that a pitched ball is so far outside of the strike zone that indicator 10 does not detect the presence of the ball. Also, the foot buttons may be pressed to adjust the strike count in the event the batter swings at a pitch which would otherwise have been called a "ball." The foot buttons are also pressed to reset the ball/strike indicator to a zero count. A pair of foot buttons are provided to accommodate right hand and left handed batters.

Switch 32 disposed on the upper surface of housing 12 is an on/off slide switch that is used to control the power to indicator 10. Switch 34 is a rotary switch that selects the mode in which the indicator is set. The modes are discussed below in connection with the software. Switch 36 is a rotary switch that selects one of four or more speech modes, such as a "normal" mode, a "funny" mode, etc. The speech modes are discussed below in connection with FIG. 6.

Also disposed on the upper surface of housing 12 is an output speaker 38 which outputs words or phrases such as "ball", "strike", "you're out", etc. The speaker may be turned off by moving an on/off slide switch 40.

Figure 2:
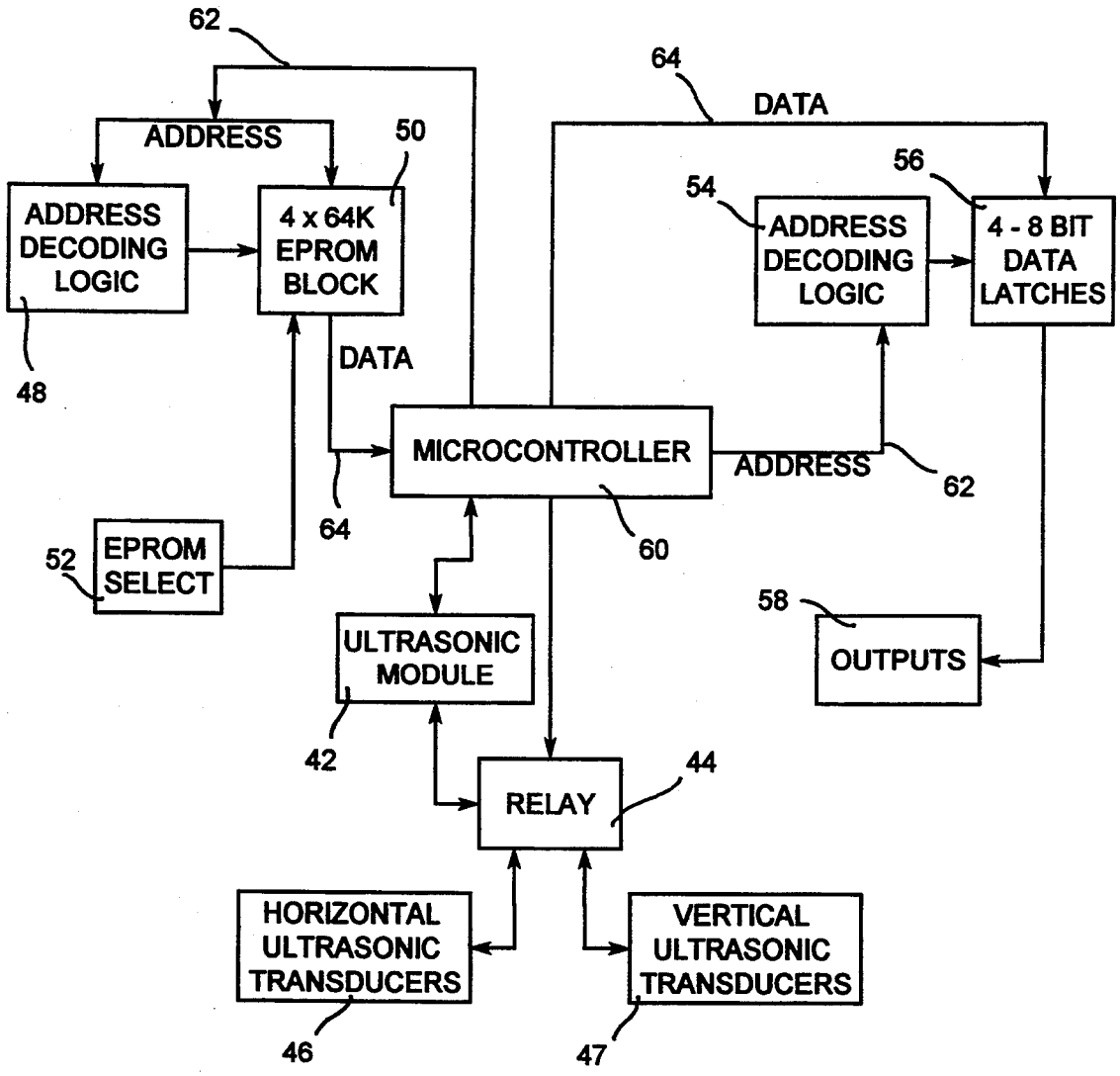
FIG. 2 is a block diagram of the circuitry used in the present invention.

FIG. 2 is a block diagram of the circuitry of the present invention. In FIG. 2, ultrasonic module 42, a relay 44, horizontal ultrasonic transducer 46 (corresponding to transducers 14 and 16), and vertical ultrasonic transducers 47 (corresponding to transducers 22–26) together comprise the ultrasonic detection circuit. Again in FIG. 2, address decoding logic 48, EPROM block 50 and EPROM select circuit 52 together comprise the digitized voice retrieval circuit.

Also in FIG. 2, address decoding logic 54, 4–8 bit data latches 56, and outputs 58 together comprise the output interfacing circuit.

All the circuitry is subject to the control of a microcontroller 60.

The circuitry depicted in FIG. 2 operates in the following manner. Microcontroller 60 controls relays 44 to determine when the ultrasonic pulses will be emitted from horizontal transducers 46 and vertical transducers 47. Microcontroller 60 then instructs ultrasonic module 42 to send out the ultrasonic pulses through the transducers. Module 42 controls relay 44, which in turn signals transducers 46 and 47 to output their signals. When a reflected signal or echo is received through transducers 46 and 47 and through relay 44 by module 42, module 42 instructs microcontroller 60. Microcontroller 60 interprets the data to determine whether the reflected signal corresponds to a pitch either within or outside of the strike zone. If the ball/strike indicator is set for a calibration mode, ultrasonic module 42 instructs microcontroller 60 to use the echo information to reset the boundaries of the strike zone.

Once microcontroller 60 determines whether the incoming pitched ball is a "ball" or a "strike", it sends an address signal on address bus 62 to address decoding logic 48. Address decoding logic 48 determines whether the currently enabled EPROM block should respond to the current address on the address bus. Decoding logic 48 determines if the address on the address bus is within the range of addresses for the EPROMs. If the address on the address bus is within the proper range, the enabled EPROM will place data on the data bus; otherwise, the EPROM will remain idle. The type of EPROM data to be output is selected by circuit 52, and is determined by the position of the speech mode switch 36 (FIG. 1). The appropriate EPROM data information is then sent via data bus 64 to micro-controller 60.

Microcontroller 60 then sends the appropriate address information via address bus 62 to address decoding logic 54. One of the four-eight bit data latches 56 is enabled by address decoding logic 54, and the output signal is sent from microcontroller 60 to the enable data latch via data bus 64. The appropriate information is then output to one or more of outputs 58, which include the ball and strike LEDs and the output speaker.

Figure 3:
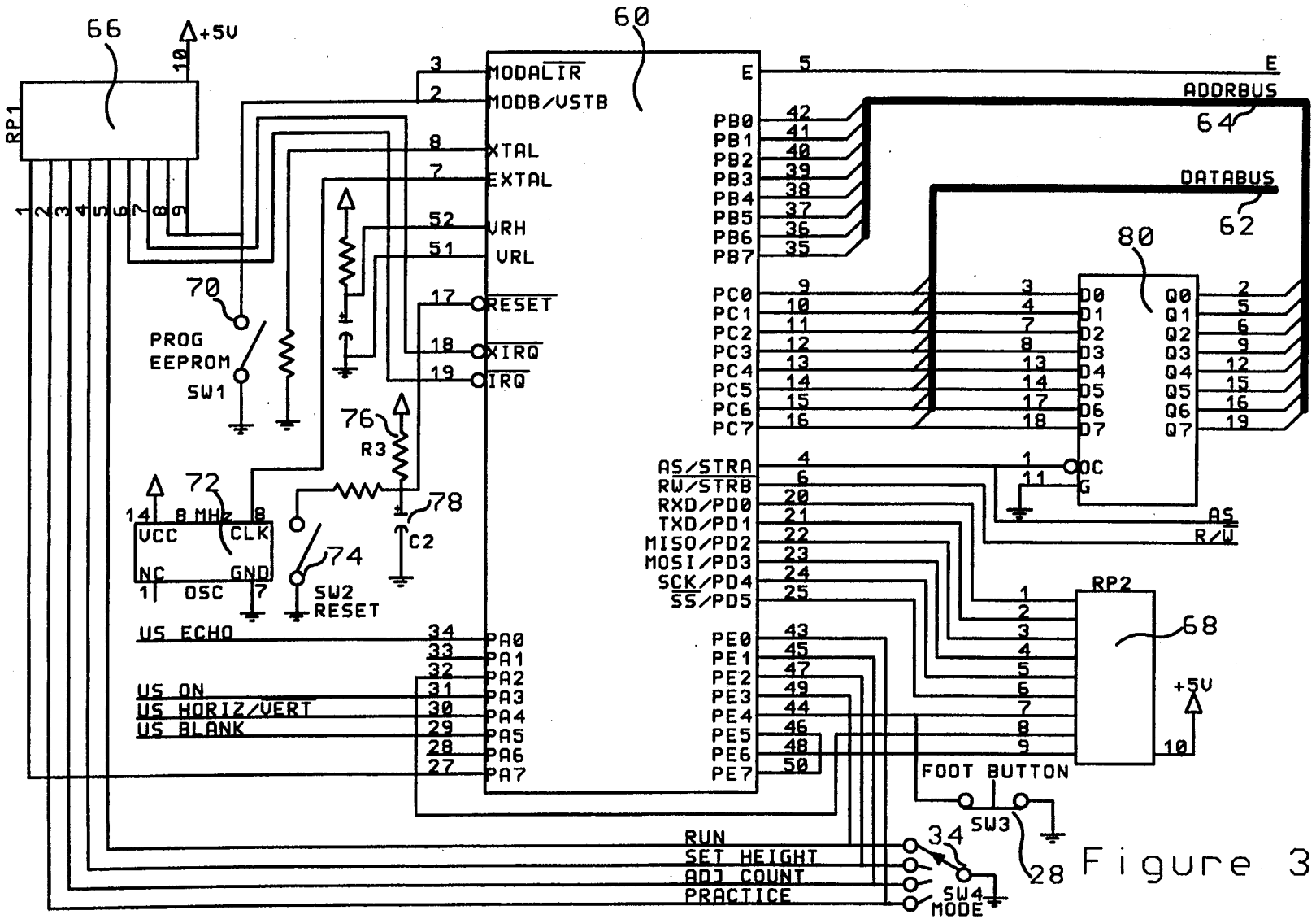
FIG. 3 is a schematic diagram of the microcontroller circuitry of the present invention.

FIG. 3 is a schematic diagram of the microcontroller circuit according to the present invention. The microcontroller is preferably a Motorola MC68HC811E2. This microcontroller is particularly desirable because it is an eight-bit device, and because it has 2048 bytes of EEPROM memory which is used to store the system's software. The microcontroller also has 256 bytes of RAM memory which is used by the program. Both the EEPROM and RAM memories are durable enough to permit any reasonable number of future software upgrades.

The Motorola MC68HC811E2 is a 52-pin device having five ports and several control signals. Port A, corresponding to pins 27 through 34, is a general input-/output port. It is set up to have four input and four output pins. The signals which control and test the ultrasonic sensing circuit are input and output via Port A.

Port B, corresponding to pins 35 through 42, are the upper eight bits of the address bus 62.

Port C is a time-multiplex address/data bus. Port C corresponds to pins 9 through 16. For the first portion of the read/write cycle, Port C contains the lower eight bits of the address bus. During the second half of the cycle, it is a data bus.

Port D is a serial interface for the microcontroller. Port D corresponds to pins 20 through 25. Except for the development of the systems software, the entire port is tied high through a pull-up resistor pack 68. During software development, pins 20 and 21 are used for serial communications with a personal computer.

Port E is the general input port, and consists of pins 43 through 50. The signals from the user are transmitted via Port E.

A more detailed explanation of FIG. 3 will now be presented. The inputs to microcontroller 60 include a mode switch 34, which selects either a "practice" mode, an "add count" mode, a "set height" mode, or a "run" mode. The "practice" mode is for pitcher practice. The "add count" or "adjust count" mode is to increment or change the current ball/strike count. The "set height" mode is used to adjust the lower and upper boundaries of the strike zone. The "run" mode is the normal mode during which a pitched ball is sensed.

Each of the switch settings for switch 34 is pulled up through a pull-up resister in resistor pack 66. Each of the switch contacts is connected to a respective pin of microcontroller 60.

Foot button switches 28 and 30 are connected to resistor pack 68 and provide a signal on pin 44 of microprocessor 60 when a foot button is pressed.

Switch 70 is connected to resistor pack 66, and is switchable between a programming mode for programming the EPROMs and an operating mode. Pin 7 of the microprocessor is connected to an eight megahertz clock 72. Switch 74 is a reset switch which, when closed, sends a reset signal to pin 17 of microprocessor 60 via an RC timing circuit consisting of resistor 76 and capacitor 78.

A latch 80 is connected to pins 9 through 16 of microprocessor 60 and is used to time-multiplex data bus 64.

Pin 29 of microprocessor 60 provides an ultrasonic blank signal—called US BLANK—to the ultrasonic module so that the module will reset and listen for another echo or reflected signal. The US BLANK signal is not used in the present invention.

Pin 30 of microprocessor 60 is connected to a relay which determines which set of transducers is currently activated. That is, whether the transducers that are currently activated are the horizontal ultrasonic transducers 46 (FIG. 2) or the vertical ultrasonic transducers 47.

Pin 31 of microprocessor 60 outputs a "US ON" signal to the ultrasonic detection circuitry to instruct the ultrasonic circuitry to send out a pulsed ultrasonic signal. Pin 34 of microprocessor 60 receives a US ECHO signal from the ultrasonic detection circuit when an object has been sensed.

Pin 6 of microcontroller 60 receives a read/write signal R/W. The R/W signal indicates whether an external read signal or write signal is occurring. A logical high signal indicates that data is being read, whereas a logical low signal indicates that data is being written. The R/W signal is used to coordinate the data being written to the output devices, and the data being read from the external EPROMs.

The AS signal present at pin 4 of microprocessor 60 indicates when a valid external address is present on the address pins of microcontroller 60. On the falling edge of the AS signal, the signals on the address lines are latched until the read or write operation is completed.

The E signal present on pin 5 of microcontroller 60 is the clock that the internal circuitry of microcontroller 60 uses. The E signal is also used external of the microcontroller to latch data at the proper time. The E signal is one-fourth of the clock signal on the EXTAL and XTAL pins, namely pins 7 and 8 respectively. Thus, the E signal has a frequency of two megahertz.

The MODA and MODB signals present on pins 3 and 2 respectively on microcontroller 60 dictate the mode of the microcontroller. Under normal use, both signals will be tied high through pull-up resistors 66. During programming, the signals are both tied directly to ground.

The remaining pins of the microprocessor are not used, and are tied high through pull-up resistors.

Figure 4:
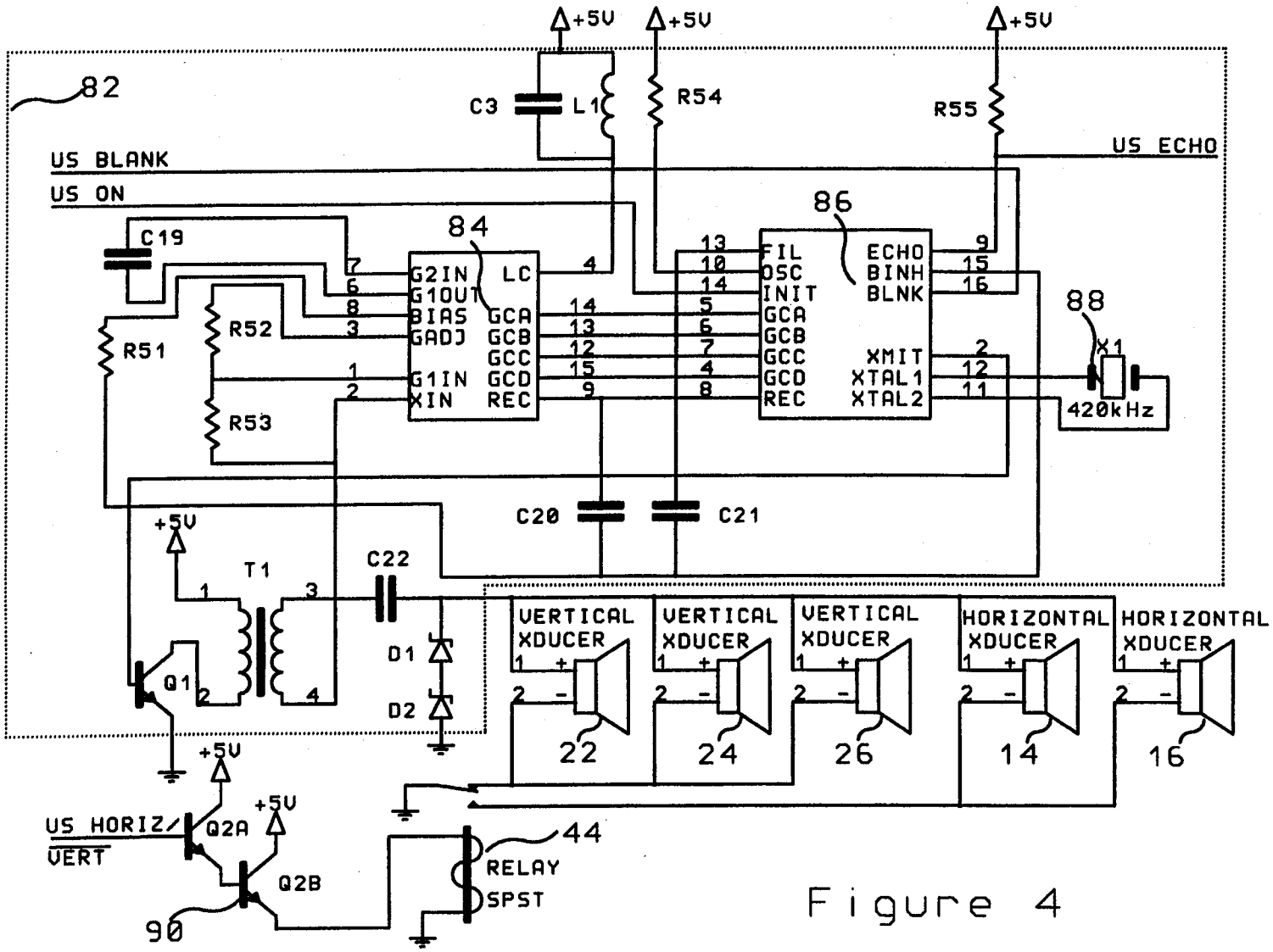
FIG. 4 is a schematic diagram of the ultrasonic detection circuitry according to the present invention.

FIG. 4 is a schematic diagram depicting the ultrasonic detection circuitry. Most of the elements of FIG. 4 are contained in an ultrasonic module 82, indicated by the dotted lines. Module 82 is an integrated circuit, sonar ranging module available from Texas Instruments under part number SN28827. The specifications of module 82 are contained in a publication entitled "Sonar Ranging Module", D2780, October 1983, published by Texas Instruments, which is incorporated by reference herein.

Sonar ranging module 82 includes a pair of sonar ranging integrated circuits 84 and 86. Module 82 is suitable for driving 50-kilohertz, 300 volt electrosonic transducers with no additional interface. This module, with a simple interface, is able to measure distances of 6 inches to 35 feet. The typical absolute accuracy is plus or minus two percent at one foot or greater.

Module 82 includes an accurate, ceramic-resonator-control 420-kilohertz time-base generator 88. The sonar transmit output is 16 cycles at a frequency of 49.4 kilohertz. Module 82 operates over a supply voltage range from 4.5 volts to 6.8 volts. As used in the present invention, the module is set in a single-echo mode.

As depicted in FIG. 4, module 82 drives transducers 14 and 16, as well as transducers 22, 24, and 26. The enabling of the transducers is controlled by a Darlington transistor pair 90, which in turn is responsive to a signal present on the US HORIZ/VERT BAR line connected to pin 30 of microprocessor 60 (FIG. 3). Module 82 is enabled by a signal present on the line labelled US ON (FIG. 4).

When a high signal is present on line US ON, module 82 emits 16 pulses of 50 kilohertz ultrasonic signals. The module then begins waiting for any of these pulses to be reflected back towards the transducers. The signal on line US ON can be taken low at any time to reset the sequence.

The echo signal on pin 9 of circuit 86 is controlled from within module 82. Pin 9 is driven to a high logic level by a US ECHO signal when the transducer detects the reflected 50 kilohertz ultrasonic pulses. Once the reflected pulses have been detected, the signal at pin 9 remains high until it is taken low by the US 0N signal or by the BLNK signal on pin 16 of circuit 86. In most cases, the time between the US ON signal and the US ECHO signal is used to determine an object's distance from the system.

The US BLANK signal is not used, since the present invention has no need to detect multiple echoes from multiple targets. Similarly, the VINH and the OSC signals are not used in this application.

The software program in microcontroller 60 controls all the activities of the ultrasonic detection circuitry. The program typically first uses the HORIZ signal to control the output of the horizontal ultrasonic pulses. Next, the program will signal module 82 to transmit the string of ultrasonic pulses. Lastly, the software program will count until an echo is received. In most cases, the program will count only for a certain amount of time before continuing. This same procedure is used for vertical ultrasonic measurements.

The horizontal and vertical transducers used in the present invention are electrostatic transducers available from Kodak. Electroacoustic transducers may be preferred, however, since they may be more suitable for outdoor use. A transducer used with the present system should be capable of sending a pulse for at least 20 feet and receiving an echo off of a baseball. The transducer should have a relatively narrow beam of about 20 degrees if it is used as a vertical transducer.

Figure 5:
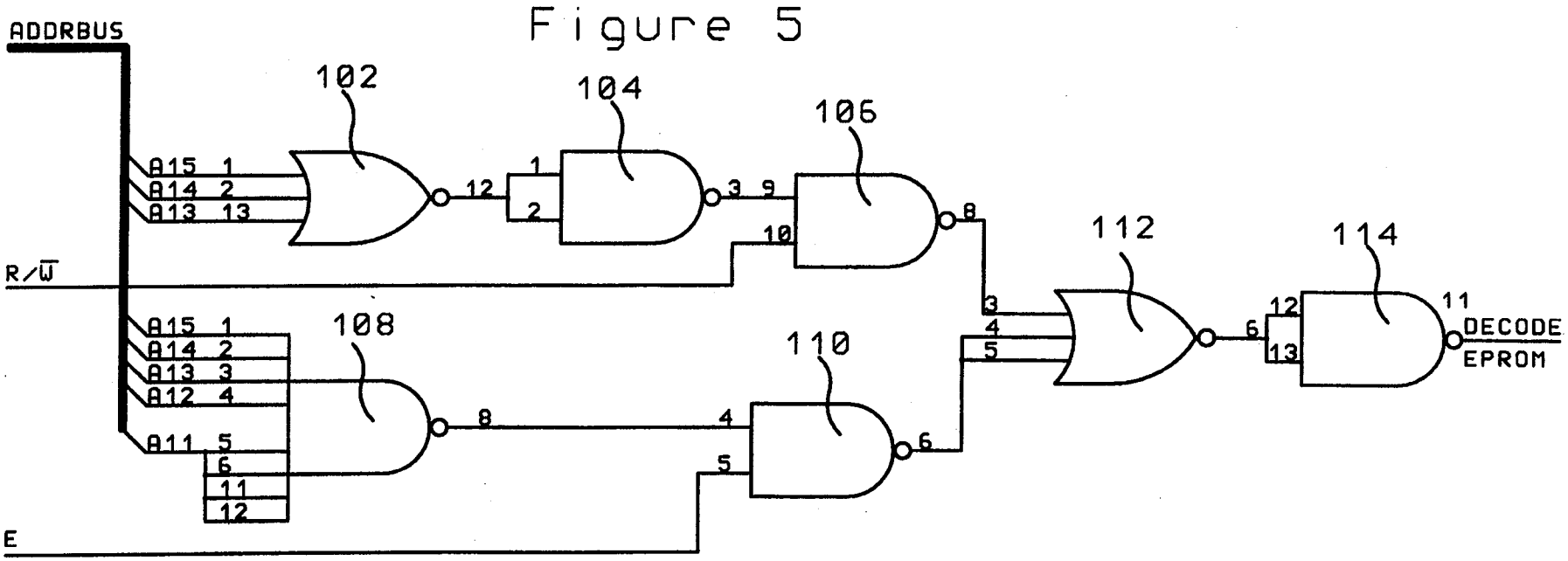
FIG. 5 is a schematic diagram of a decode circuit that determines whether the address information on the address bus is an EPROM address.
Figure 6:
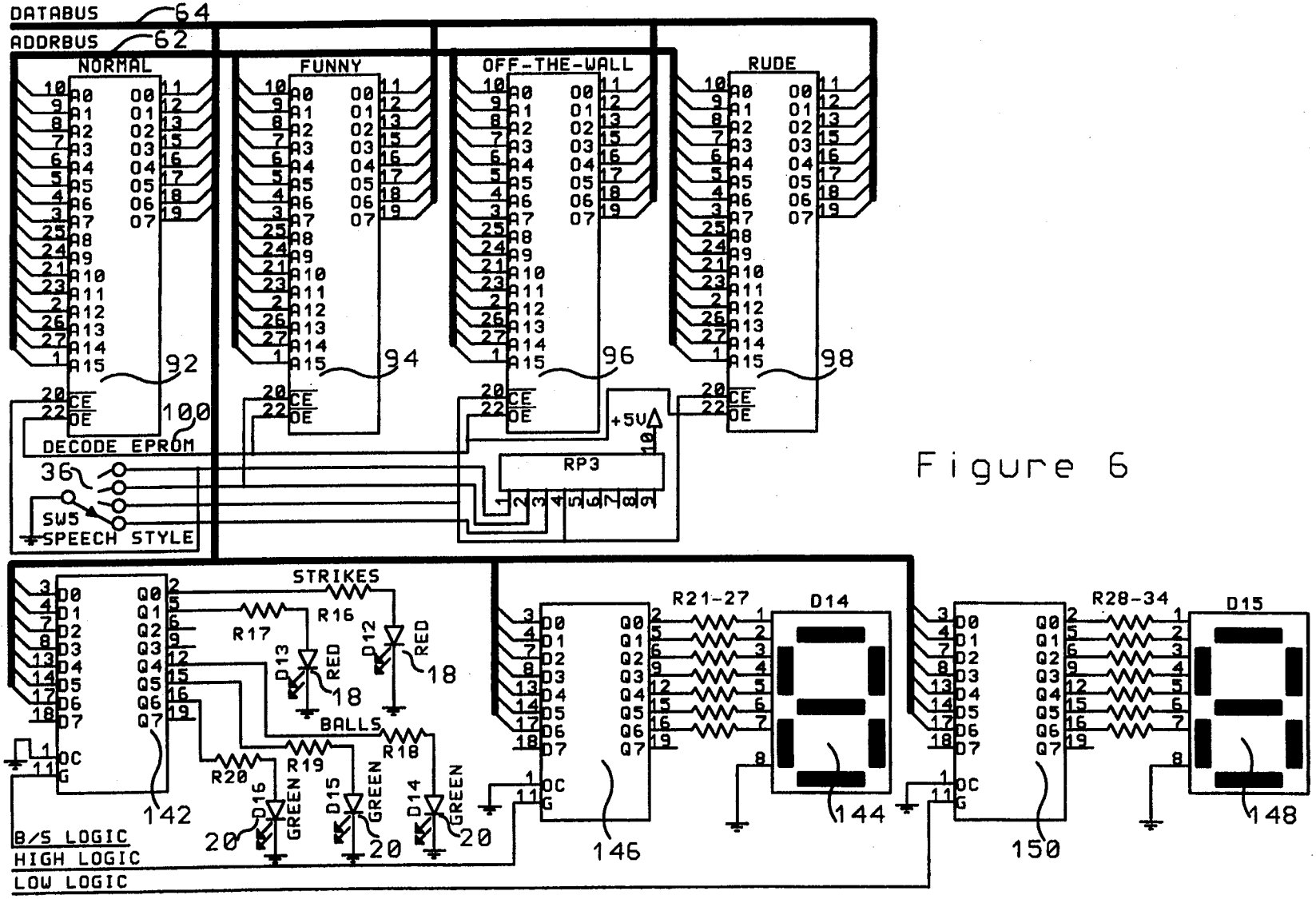
FIG. 6 is a schematic diagram of the digitized voice retrieval EPROM circuit.
Figure 7:
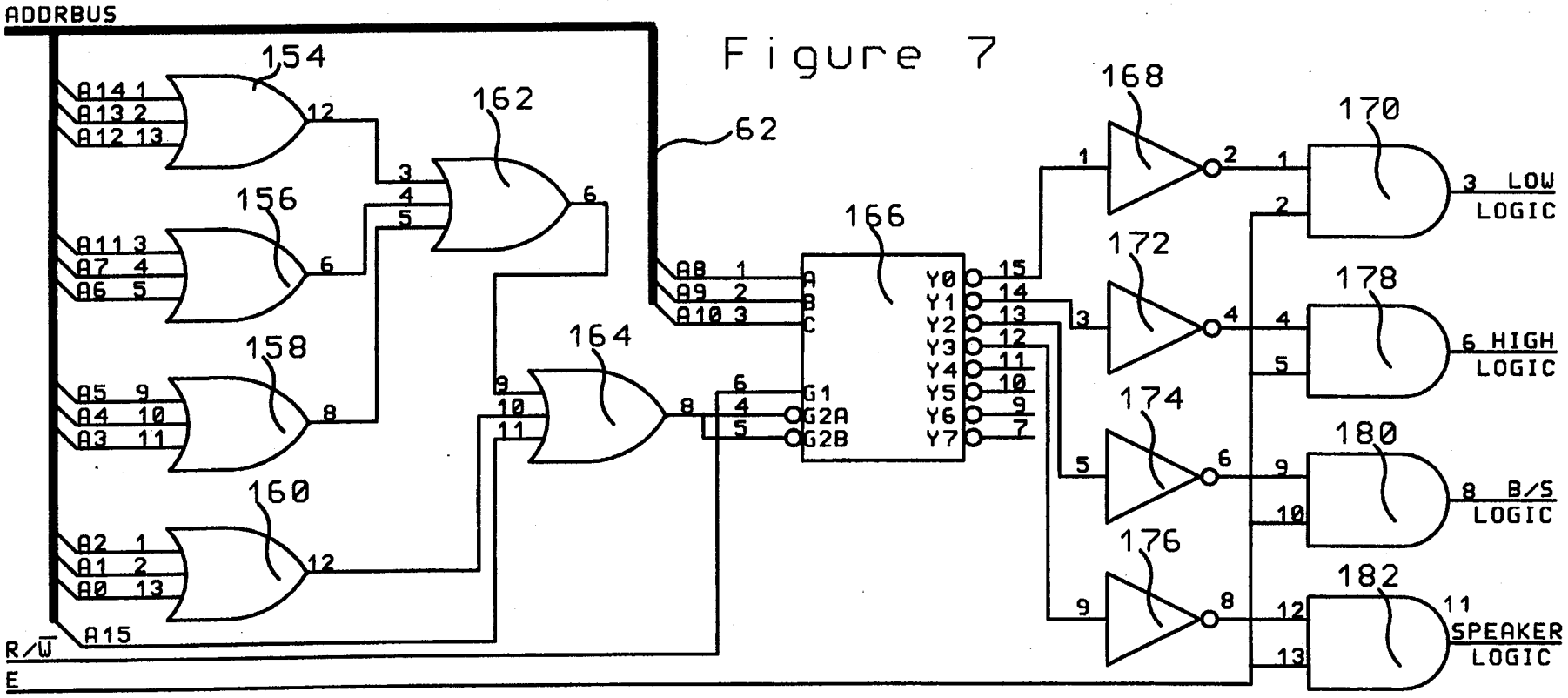
FIG. 7 is a schematic diagram of the address decode logic used to obtain data from the EPROMs.
Figure 8:
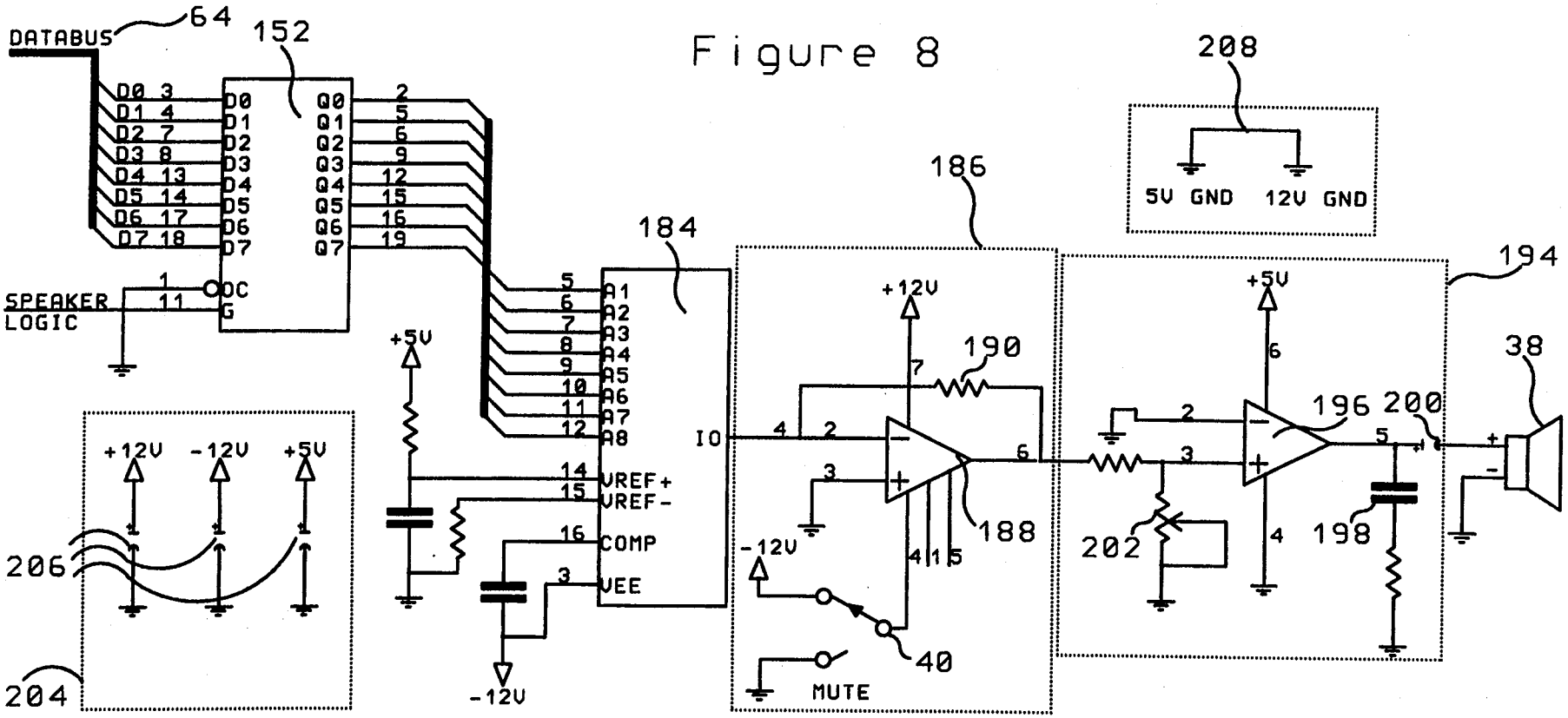
FIG. 8 is the output circuit that generates an analog voice signal.

The circuit by which a voice or visual output is generated consists of the schematics depicted in FIGS. 5 through 8. FIGS. 5 and 7 depict decoding circuits. FIG. 6 depicts the EPROM circuit and the circuit which generates the visual outputs. FIG. 8 depicts the digital-to-analog converter, and smoothing circuits which generate the audible output.

Referring first to FIG. 6, four EPROMs 92, 94, 96 and 98 are used in a preferred embodiment to provide a variety of output voices. EPROM 92 outputs a "normal" voice. EPROM 94 outputs a "funny" voice. EPROM 96 outputs a "off the wall" voice and EPROM 98 may output a "rude" voice. Switch 36 selects the particular EPROM, and is connected to the chip enable pin 20 of each of the EPROMs.

The DECODE EPROM signal on line 100 is the output signal from the decode circuitry depicted in FIG. 5. A signal is present on line 100 only when the address signals on the address bus correspond to the range of addresses for the EPROMs. Otherwise, the signals on the address bus are for another circuit, and the EPROMs are not addressed.

Referring now to FIG. 5, the address present on address bus 62 consists of address bits A11 through A15. FIG. 5 depicts the EPROM decode circuit used in the present invention. NOR gate 102 and NAND gate 104 determine if the current address on the address bus is greater than or equal to the lower limit of the range of valid addresses for the EPROMs. If any of signals A15, A14 or A13 is high, the address is above the lower limit. In this case, the output of gate 102 will be low. Gate 104 is set up as an inverter and will place a high signal on the input of NAND gate 106 if the address is above the lower limit. Signal R/W from the microprocessor will be high if a read operation is being performed; the EPROMs only respond to read operations. When both inputs to gate 106 are high, the output of gate 106 will be low. This indicates that the address is above the lower limit and that a read operation is being performed.

NAND gate 108 determines if the address on the address bus is too high. If A15, A14, A13, A12 and A11 are all high, the address is too high. If any of the inputs to gate 108 is low, the address is valid and the output of gate 108 will be high. The signal E is a timing signal from the microprocessor. When the E signal is high, the microprocessor is ready for data. When both inputs to NAND gate 110 are high, the output of NAND gate 110 will be low. This indicates that the address is below the upper limit of the EPROM address range, and that the microprocessor is ready.

When both inputs to NOR gate 112 are low, its output will be high. NAND gate 114 is set up is an inverter. When the address on the address bus is valid and the control signals are correct, the input to gate 114 will be high, and its output will be low. When the DECODE EEPROM signal is low, the currently enabled EPROM will respond to the address on the address bus.

The bottom portion of FIG. 6 depicts the output circuits for the visual indicators. These visual indicators include the LEDs indicating "strikes", the LEDs indicating "balls", and two-seven segment LED displays whose functions are described below in connection with the software program. In FIG. 6, LEDs 18 indicate the number of strikes in the current batter count. LEDs 20 indicate the number of balls in the current ball/strike count. The data from data bus 64 is latched in a latch 142. Latch 142 is addressed by the presence of an appropriate BS logic signal present on pin 11 of latch 142. The BS logic signal is output from the circuit described below in connection with FIG. 7.

Similarly, the seven-segment LED display 144 is latched by latch 146. Latch 146 is addressed by a HIGH LOGIC signal applied to pin 11 of latch 146. The HIGH LOGIC signal is output from the circuit depicted in FIG. 7.

Seven-segment display 148 is similarly latched by a latch 150, that is addressed by a LOW LOGIC signal present on line 11 of latch 50. The LOW LOGIC signal is output from the circuit depicted in FIG. 7.

The circuit depicted in FIG. 7 is an address decoding circuit that decodes the address signals for the four output latches. These output latches include latches 142, 146, and 150 (FIG. 6) as well as a speaker output latch 152 (FIG. 8).

In FIG. 7, address bus 62 has its address bits A0 through A7, and A11 through A14 input to a series of OR gates 154, 156, 158 and 160. Bit A15 is input to OR gate 164. Bits A8, A9 and A10 are input to a three-bit to eight-bit decoder chip 166. The output of OR gate 164 is connected to pins 4 and 5 of decoder chip 166. The nature of the three-bit digital word input to decoder 166 determines which of the outputs of chip 166 goes high. The outputs pins 11 through 15 of chip 166 correspond to the four output latches discussed above. For example, if the three-digit binary word input to decoder 166 is 000, then the output of pin 15 of decoder 166 will be low. That signal is inverted by invertor 168 to a logical high, which is input to AND gate 170. The other input to AND gate 170 is connected to the E clock signal. Inverters 172, 174, and 176 are similarly connected to their respective output pins 14 through 12. The outputs of inverters 172 through 176 are connected to their respective AND gates 178, 180, and 182.

FIG. 8 converts a digital output signal of the microcontroller corresponding to the desired voice output into an analog signal, then filters that signal so that it sounds more like a human voice. In FIG. 8, the data signal from data bus 64 is latched by speaker latch 152 into a digital to analog converter 184. Latch 152 is responsive to a SPEAKER LOGIC signal, which is the output signal of AND gate 182 of FIG. 7.

In FIG. 8, the analog output of converter 184 is filtered by a filter circuit. The circuit in box 186 converts the current signal output of converter 184 to a voltage signal. Box 186 includes an operational amplifier 188, a feedback resistor 190, and a mute switch 40 which allows the audio output to be eliminated.

The circuit in box 194 includes an operational amplifier 196 and capacitors 198 and 200 to drive speaker 38. Box 194 also includes a volume potentiometer 202 for varying the level of audio output.

Box 204 contains capacitors 206 that reduce noise on the +12 volt, −12 volt and +5 volt supply lines. Box 208 indicates that the ground for the 12 v and 5 v supplies are electrically the same.

FIGS. 9 through 24 together comprise a software flowchart for the software used to run microprocessor 60. The primary responsibility of the software is to coordinate the user inputs, the outputs, and the sensing circuits. The main flow of the program polls the user inputs and then takes the appropriate actions.

Figure 9:
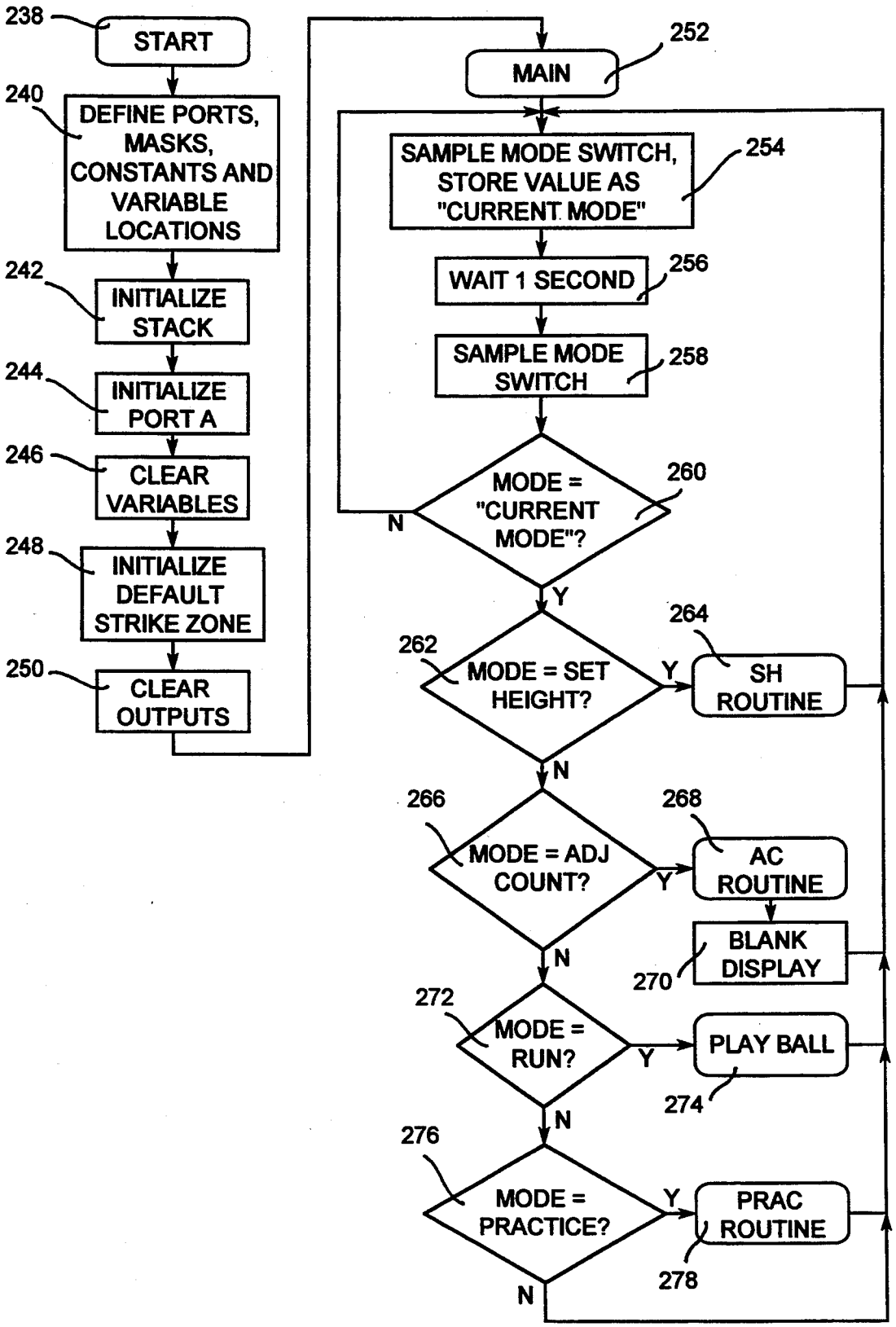
FIGS. 9 through 24 together comprise a flowchart of the software used to operate the microcontroller.

Referring now to FIG. 9, after the program is started at Step 238, the ports, masks, constants and variable locations are defined at Step 240. The memory stack is initialized at Step 242, and Port A of the microprocessor is initialized at Step 244. All variables are cleared at Step 246, and a default strike zone is initialized at Step 248. Finally, all outputs are cleared at Step 250. The program then proceeds to the MAIN program loop 252.

Main Program

The main loop of the program is responsible for polling the mode switch and selecting the correct program subroutine to execute. The mode switch is the primary user control that defines what the user wants to do. The four positions of the mode switch are labeled with "Run", "Set Height", "Adjust Count", and "Practice".

In the "Run" mode, ball/strike indicator 10 determines whether an incoming pitch is either a ball or a strike. The number of balls and strikes are counted until four balls or three strikes have accumulated, or until another predetermined count has been reached. When this occurs, the count is cleared.

The "Set Height" mode is used to set the upper and lower boundaries of the strike zone. As stated above, the boundaries vary depending upon the height of the batter. The user is first prompted to define the lower boundary by holding an object, such as a ball, bat or a hand, at the lower boundary. The foot button is then pressed, and the device measures the distance between the object and the unit. This process is then repeated for the upper boundary.

The "Adjust Count" mode is used to adjust the number of balls and strikes in the current ball/strike count. First, the number of balls is incremented once per second (e.g. 0, 1, 2, 3, 0, etc. beginning with the current number) until the foot button is pressed. The number of strikes is similarly incremented until the foot button is again pressed. The new count is then stored and indicator 10 waits for the mode switch to be moved.

The "Practice" mode is very similar to the "Run" mode in that it determines whether the incoming pitch is either a ball or a strike. In the Practice mode, however, indicator 10 simply indicates whether the pitch was a ball or a strike, without incrementing the count. Either the green LEDs or the red LEDs blink, depending upon whether the pitch was a ball or a strike.

Referring again to FIG. 9, main loop 252 first samples the mode switch and stores the sample value as the current mode at Step 254. After a one second delay at Step 256, the mode switch is sampled again at Step 258. A determination is made at Step 260 whether the present mode setting corresponds to the value stored as "current mode". If the answer is No, the program returns to Step 254. If the answer at Step 260 is Yes, a determination is made at Step 262 whether the current mode value is equal to the Set Height mode. If the answer at Step 262 is Yes, subroutine SH ROUTINE is called at Step 264.

If the answer at Step 262 is No, a determination is made at Step 266 whether the current mode is the ADJUST COUNT mode. If the answer at Step 266 is Yes, subroutine AC ROUTINE is called at Step 268, and the two output seven-segment displays are blanked at Step 270.

If the answer at Step 266 is No, a determination is made at Step 272 whether the current mode is the RUN mode. If the answer at Step 272 is Yes, a PLAY BALL subroutine is called at Step 274.

If the answer at Step 272 is No, a determination is made at Step 276 whether the current mode is the PRACTICE mode. If the answer at Step 276 is Yes, a PRAC ROUTINE is called at Step 278. If the answer at Step 276 is No, the program returns to Step 254.

SH ROUTINE

Figure 10:
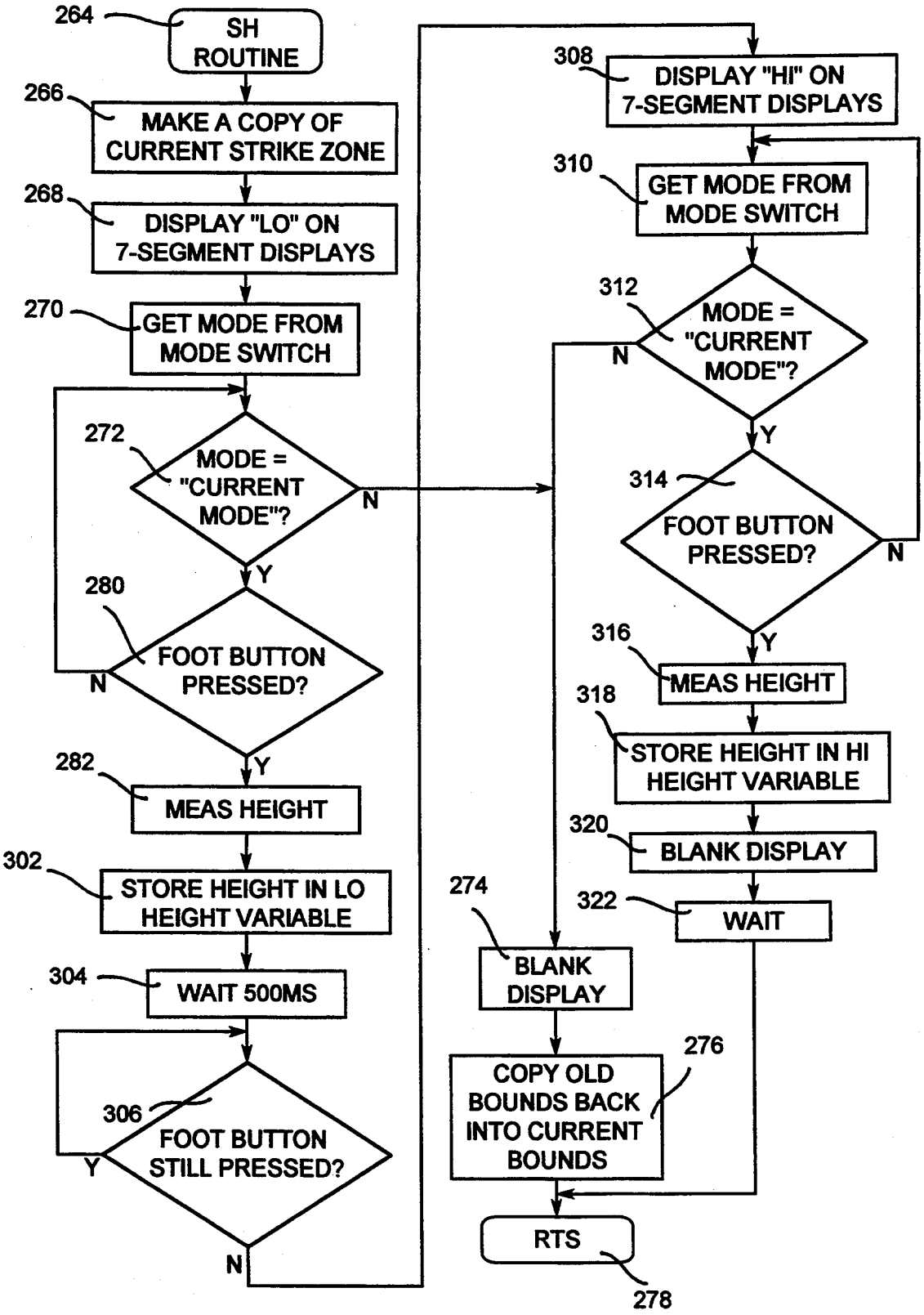

The routine which sets the upper and lower boundaries of the strike zone, called SH ROUTINE 264, is depicted in FIG. 10. The first Step of routine 264 is to make a copy of the current strike zone boundaries at Step 266. The purpose of this Step is to prevent a loss of the prior settings in the event that the user leaves the SET HEIGHT mode before both the upper and lower boundaries have been changed since neither limit will be altered in that case. At Step 268, the two seven-segment displays output the letters LO to indicate that the lower boundary is being set. The present mode is then obtained from the mode switch at Step 270, and a determination is made at Step 272 whether the present mode is equal to the stored current mode. If the mode switch has been changed from the SET HEIGHT position, the seven-segment displays are blanked at Step 274 and the old boundaries are copied back into the memory locations containing the current boundaries at Step 276. The program then returns to start at Step 278.

Figure 11:
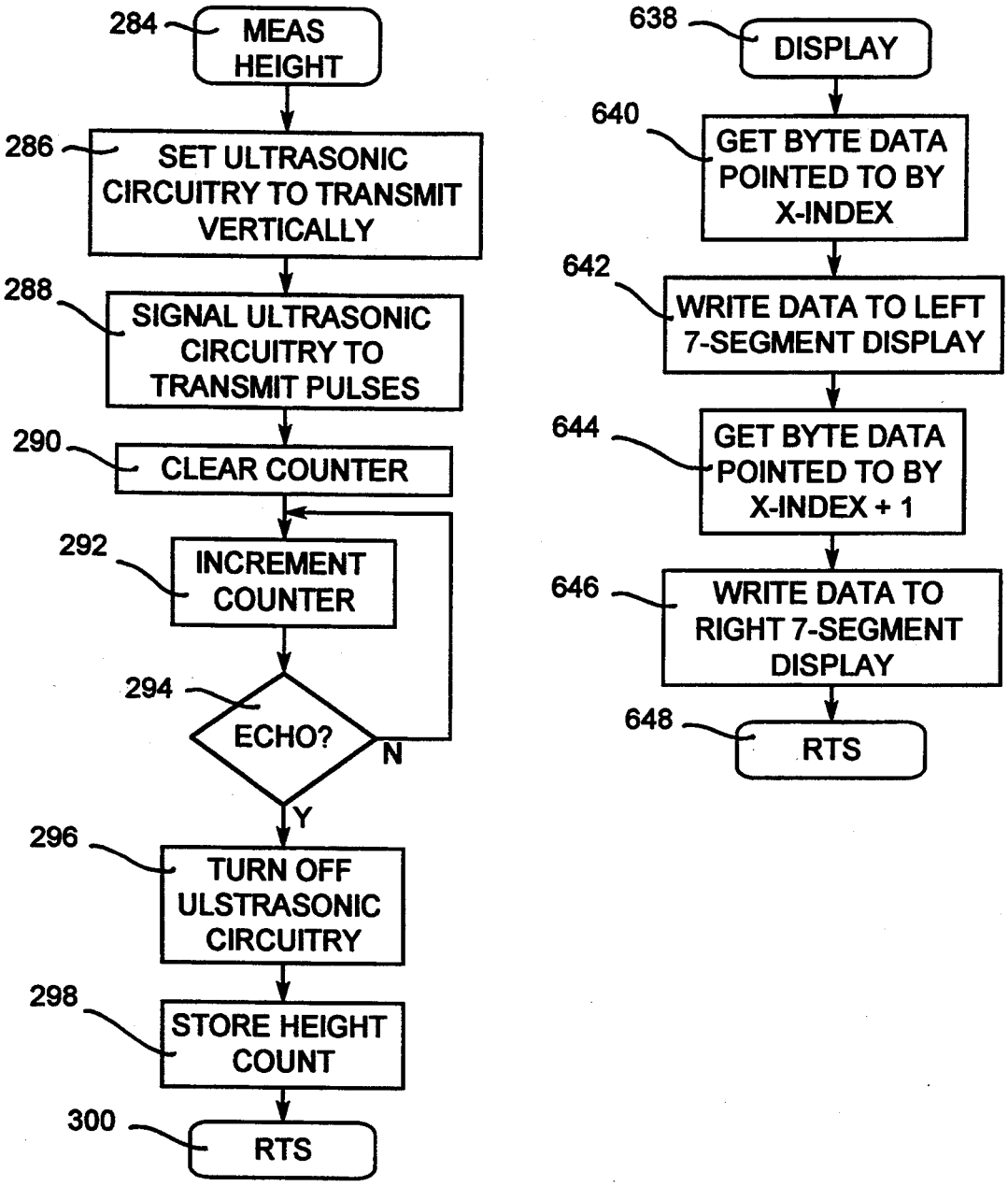

If the mode switch is in fact set to the SET HEIGHT mode, the answer at Step 272 is Yes. The foot button is then checked at Step 280. If the foot button is not being pressed, the routine goes back and checks the mode switch again. This process is repeated until either the mode switch moves or the foot button is pressed. Once the foot button is pressed, the MEAS HEIGHT routine is called at Step 282. This routine triggers the ultrasonic circuitry to measure the height of an object above the device. The MEAS HEIGHT routine is depicted in FIG. 11. This routine measures the height of an object by transmitting a set of ultrasonic pulses straight above indicator 10 and waiting for an echo or reflected signal. The time interval between the transmission and echo reception is measured to find the height of the object.

MEAS HEIGHT ROUTINE

The MEAS HEIGHT routine first sets up the ultrasonic circuitry to transmit vertically at Step 286. This step involves the activating of a relay which connects the vertical transducers to the pulse generating circuitry. At Step 288, a signal is output from the microcontroller to the ultrasonic module, causing the module to transmit a train of pulses. At Step 290, a time counter is cleared to prepare for counting. The process of timing the interval is a matter of repeatedly checking the response from the ultrasonic module. If an echo has not been received, the time counter is incremented at Step 292 and the echo signal is checked again at Step 294. If an echo signal has not been received, the counter is again incremented at Step 292 and the echo signal is checked again at Step 294.

Once an echo signal has been received, the ultrasonic module is reset at Step 296 and the height count is stored into a "16" variable at Step 298. The program then returns to the subroutine that called it at Step 300.

SH ROUTINE

Referring back to FIG. 10, the height count stored at Step 298 (FIG. 11) is stored in a LO HEIGHT variable location at Step 302. The LO HEIGHT variable is used to determine whether a pitched ball is a strike.

After a 500 millisecond delay at Step 304, a determination is made at Step 306 whether the foot button is still pressed. If the answer is Yes, the program waits until the foot button is no longer pressed. If the answer is No at Step 306, the program is ready to set the upper or "high" boundary of the strike zone. The letters HI are displayed on the seven-segment displays at Step 308, and the present selected mode is obtained from the mode switch at Step 310. A determination is made at Step 312 whether the present selected mode is equal to the stored CURRENT MODE. If the answer is No, the SET HEIGHT routine is aborted and the display is blanked at Step 274. If the answer at Step 312 is Yes, a determination is made at Step 314 whether the foot button is pressed. Assuming that the foot button has been pressed to set the upper boundary, the MEASURE HEIGHT subroutine is again called at Step 316. The MEASURE HEIGHT subroutine operates in the same manner as discussed above in connection with setting the lower boundary. The resultant height determined by the MEASURE HEIGHT subroutine is stored in a HI HEIGHT variable at Step 318. The seven-segment display is blanked at Step 320 and the WAIT subroutine is entered at Step 322.

WAIT ROUTINE

Figure 23:
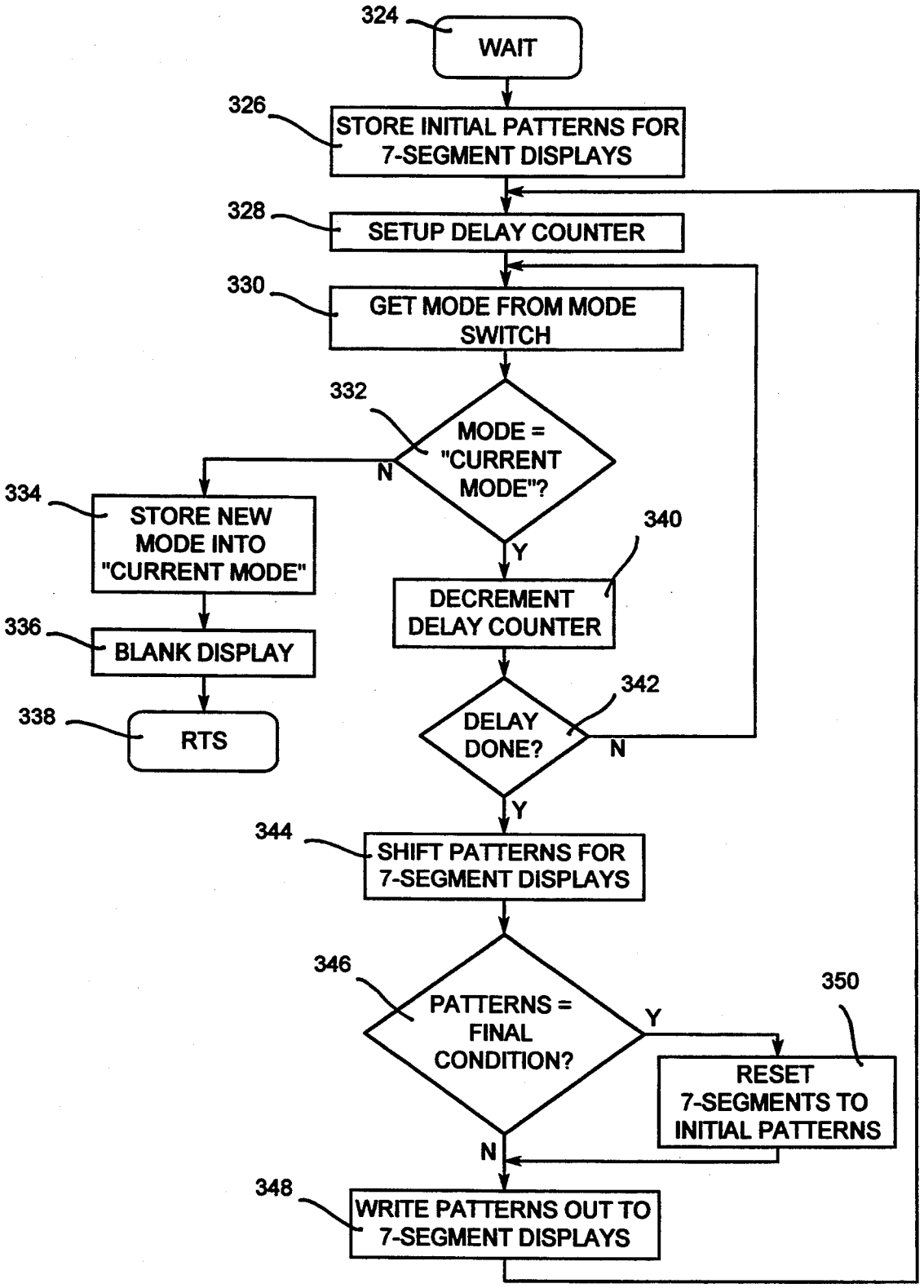

The WAIT routine is depicted in FIG. 23. This routine places repeating patterns on the seven-segment display while it waits for the mode switch to move from its current position. Once the mode switch has moved, the SH ROUTINE returns.

The WAIT routine is called after the SET HEIGHT and AC routines are called. These latter routines must wait for the mode switch to move before they are able to continue. The WAIT routine repeats until the mode switch moves off of its current position, regardless of where it is. To let the user know that the system is waiting, a rotating pattern is shown on the seven-segment display while the WAIT routine is repeated.

In FIG. 23, after the WAIT routine is entered at Step 324, an initial pattern for the seven-segment display is stored at Step 326. A delay counter is set up at Step 328 and the present mode is obtained from the mode switch at Step 330. A determination is made at Step 332 whether the present mode is equal to the stored current mode. If the answer at Step 332 is No, the new, present mode is stored into the "current mode" memory location at Step 334. The display is then blanked at Step 336 and the program returns to the subroutine that had called it at Step 338.

If the answer at Step 332 is Yes, the delay counter is decremented at Step 340 and a determination is made at Step 342 whether the total delay has timed out. If the answer at Step 332 is No, the program returns to Step 330. If the answer at Step 342 is Yes, the patterns for the seven-segment displays are shifted at Step 344. A determination is then made at Step 346 whether the patterns have reached their final position. If the answer at Step 346 is No, the patterns are written out to the displays at Step 348, and the program returns to Step 328. If the answer at Step 346 is Yes, the seven-segment patterns are set to their initial patterns at Step 350.

AC ROUTINE

Referring again to FIG. 9, if the determination at Step 266 is Yes, the AC routine is called at Step 269.

Figure 12:
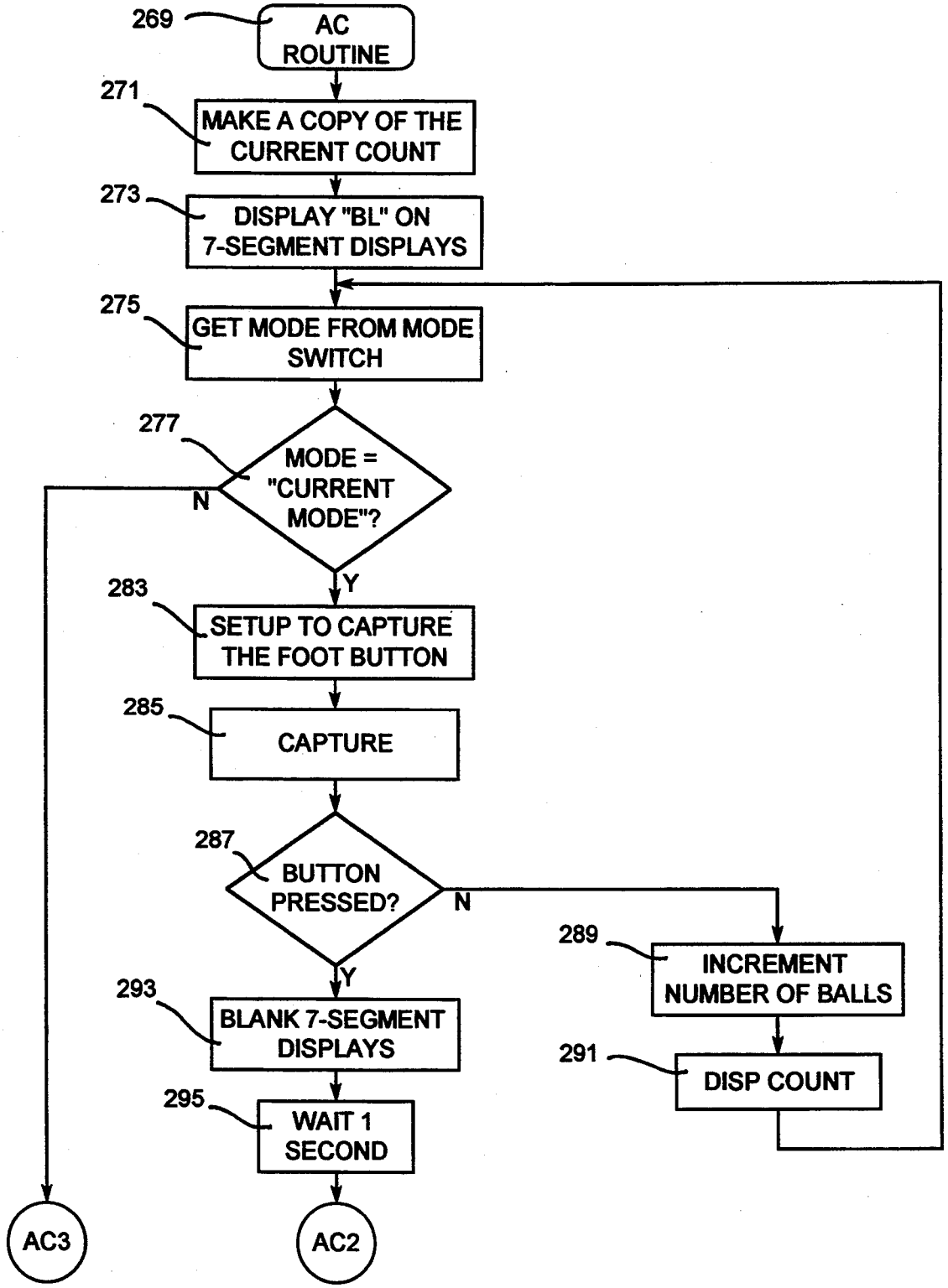

The AC routine is depicted in FIG. 12. This routine is called whenever the user has moved switch to the "Adjust Count" position. This mode switch selection is used to correct a missed pitch. In FIG. 12, routine 269 first makes a copy of the current count at Step 271. Should the mode switch be moved from the "Adjust Count" position before both the balls and strikes have been adjusted, the previous count will be restored. At Step 273, the routine then puts the letters "bL" on the seven-segment displays to indicate to the user to adjust the ball count first. The mode switch setting is then obtained from the mode switch at Step 275. At Step 277, a determination is made whether the present mode is the stored "current mode". If the answer at Step 277 is No, the previous count is restored and displayed on the ball/-strike LEDs at Step 279 (FIG. 13) and the DISP COUNT subroutine is called at Step 281. If the answer at Step 277 is Yes, the mode switch is still in the "Adjust Count" position, and the routine begins adjusting the count.

Starting with the current number, the number of balls is increased one at a time until the foot button is pressed. After the number reaches three, the number is returned to zero, where it begins increasing again. After each increment of the number, the DISP COUNT routine is called to display the new count. The mode switch is also checked after each increment to insure that it has not moved. The CAPTURE routine is used to determine if the foot button is pressed. The CAPTURE routine monitors any input for an amount of time and indicates whether the switch connected to that input was pressed or not. Before the CAPTURE routine is called each time, the AC routine sets up the CAPTURE routine to look at the input from the foot button for one second at Step 283. The CAPTURE routine is then called at Step 285. After the CAPTURE routine returns, a determination is made at Step 287 whether the foot button has been pressed. If the answer is No, the number of balls is incremented at Step 289 and the DISP COUNT routine is called again at Step 291.

Figure 13:
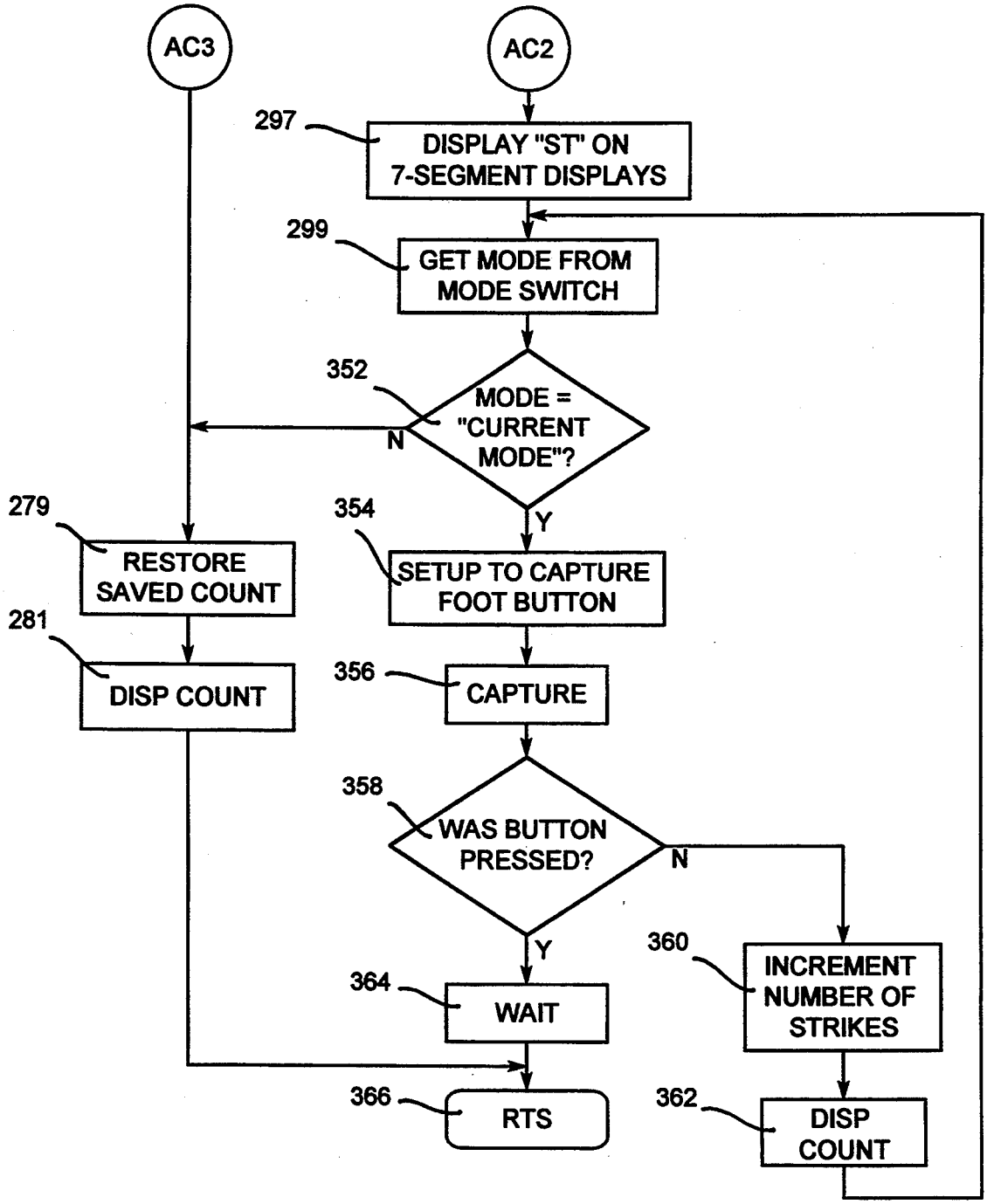

If the answer at Step 287 is Yes, the seven-segment displays are blanked at Step 293 and a one second delay is imposed at Step 295. As shown in FIG. 13, the letters "St" are then displayed on the seven-segment displays at Step 297. The present setting for the mode is then obtained from the mode switch at Step 299, and the determination is made at Step 352 whether the present setting of the mode has been changed. If the answer is No, the program proceeds to Step 279. If the answer at Step 352 is Yes, the program is set up to capture the foot button at Step 354, and the CAPTURE routine is called at Step 356. After returning from the CAPTURE routine, a determination is made at Step 358 whether the foot button is being pressed. If the answer at Step 358 is No, the number of strikes is incremented at Step 360, and the DISP COUNT subroutine is called at Step 362. If the answer at Step 358 is Yes, the WAIT subroutine is called at Step 364. When the program returns from the WAIT subroutine, it returns to the main routine at Step 366.

DISP COUNT ROUTINE

Figure 22:
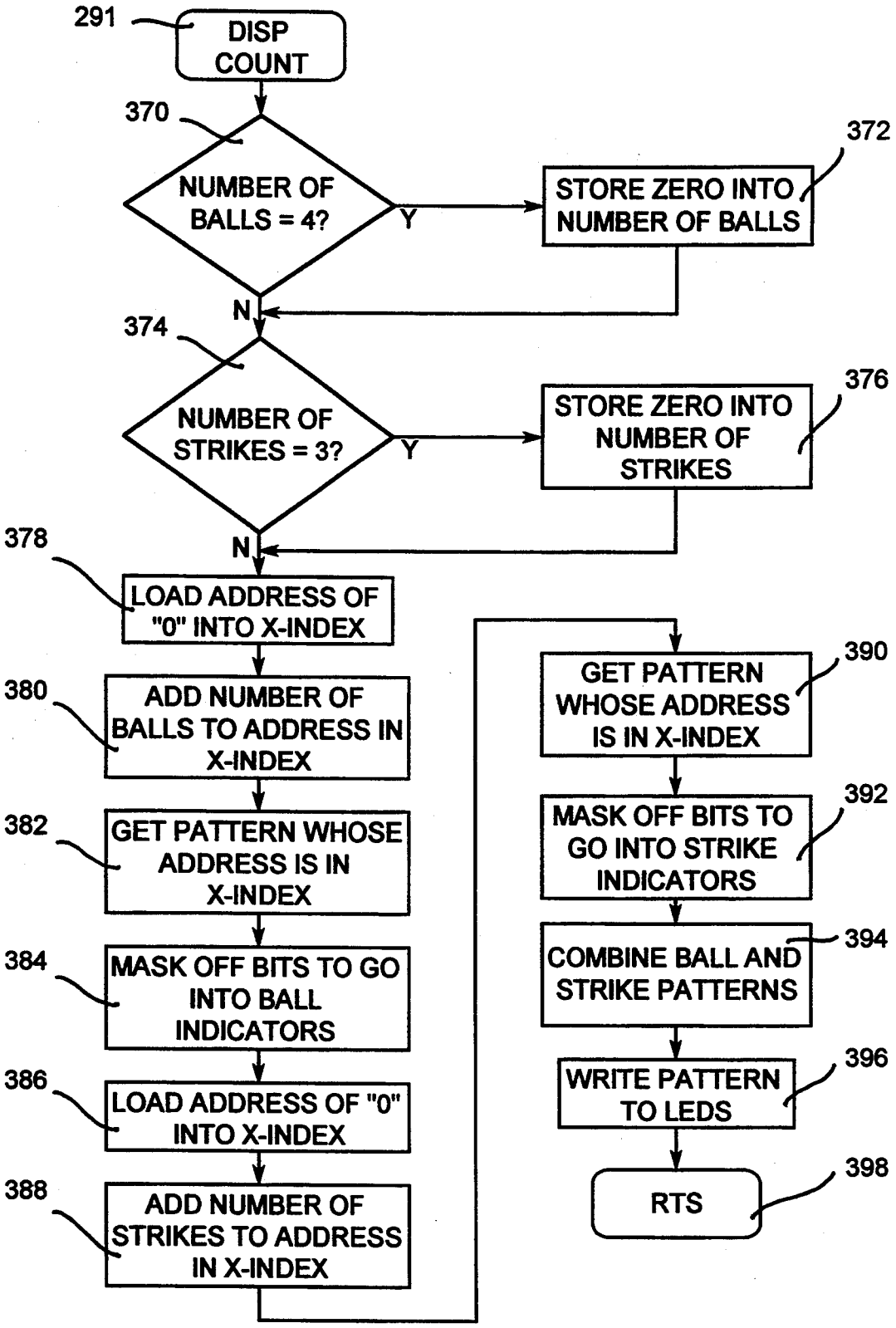

The DISP COUNT routine 281 referenced in FIG. 12 is depicted in FIG. 22. This routine updates the ball/-strike count on the red and green LEDs. First, the routine does some error checking. At Step 370, a determination is made whether the number of balls is equal to four. If the answer is Yes, the ball count is reset to zero at Step 372. Since there are only three ball LEDs and two strike LEDs, a count of four balls or three strikes has no meaning for this routine.

At Step 374, a determination is made whether the number of strikes is equal to three. If the answer is Yes, the strike count is reset to zero in Step 376.

The five ball/strike LEDs are connected to an eight-bit latch. The balls and strikes each occupy half of the latch. As with the speaker and the seven-segment displays, data is transferred to this latch as if it were any other memory location. The data for the LEDs is stored in a data table, in a similar format as the data for the seven-segment displays. The DISP COUNT routine first retrieves the data pattern for the number of balls. This is accomplished by loading the address of the data for a "zero" into the X-index register at Step 378 and offsetting it by the number of balls at Step 380. At Step 382, the data corresponding to the number of balls is then retrieved and stored in an accumulator A. Since the ball portion of the count only occupies half of the eight-bit latch, the portion that the strikes will occupy is masked from Accumulator A at Step 384. The pattern for the number of strikes is then retrieved in the same manner as for the balls at Step 386. This pattern is stored in an Accumulator B. The number of strikes is added at Step 388 and the pattern corresponding to the number of strikes is obtained at Step 390. The bits corresponding to the number of balls is masked at Step 392. The ball and strike patterns are combined at Step 394 with a resultant pattern being written to the LEDs at Step 396. The subroutine then returns to the main routine at Step 398.

CAPTURE ROUTINE

Figure 24:
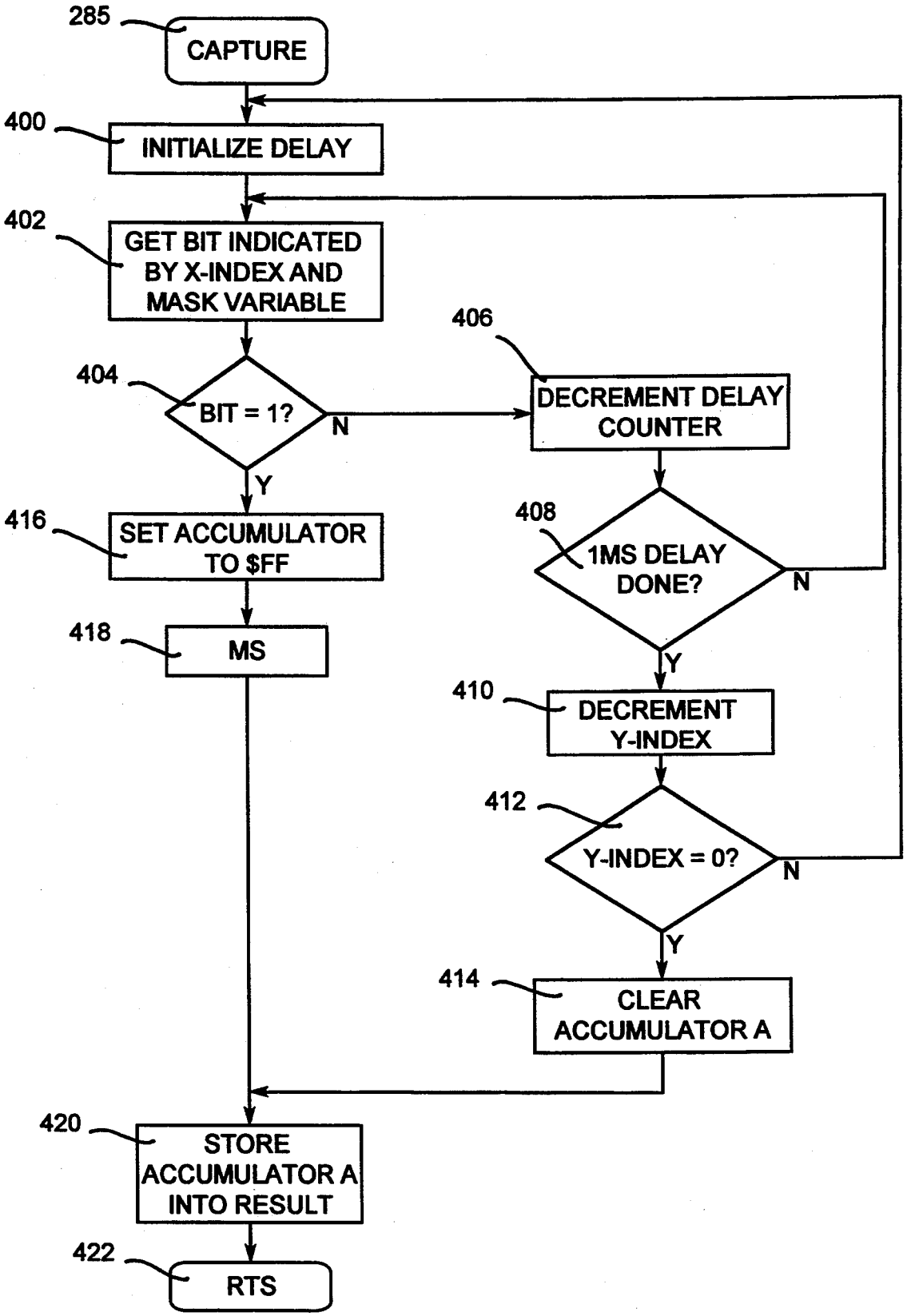

FIG. 24 depicts the flowchart for the CAPTURE routine referenced in FIG. 12. In FIG. 24, CAPTURE routine 285 waits for a given amount of time for a particular input to go high. The calling routine specifies which input to watch, and for how long. First, the CAPTURE routine initializes a delay counter at Step 400. At Step 402, the bit indicated by the X-index and the MASK variable is obtained at Step 402. At Step 404, the CAPTURE routine checks the input 133 times every 1/1000 of a second to determine if the bit is equal to a logical one. After each check of the input at Step 404, the delay counter is decremented at Step 406 as long as the input is a logical low. When the delay counter reaches zero, the time specified by the calling routine has been decremented to zero. After each decrementing of the delay counter, a determination is made at Step 408 whether a one millisecond delay has expired. If the answer is No, the routine loops back to Step 402. If the answer is Yes, the Y-index is decremented at Step 410 and a determination is made at Step 412 whether the Y-index is now equal to zero. If the answer at Step 412 is Yes, Accumulator A is cleared at Step 414.

A Yes answer at Step 404 causes Accumulator A to be set to 255 at Step 416. The MS routine is then called at Step 418 to take care of the remaining time. The MS routine is a minor delay routine that imposes a one millisecond delay. After the MS routine returns, the value stored in Accumulator A is copied to the result variable at Step 420, and the program then returns to its calling program at Step 422.

PLAY BALL ROUTINE

Referring to FIG. 9, assuming that the mode which is set to the RUN mode at Step 272, the PLAY BALL routine is called at Step 274. This routine coordinates the ultrasonic circuitry to classify pitches as balls or strikes, as well as tracking the ball/strike count.

Figure 14:
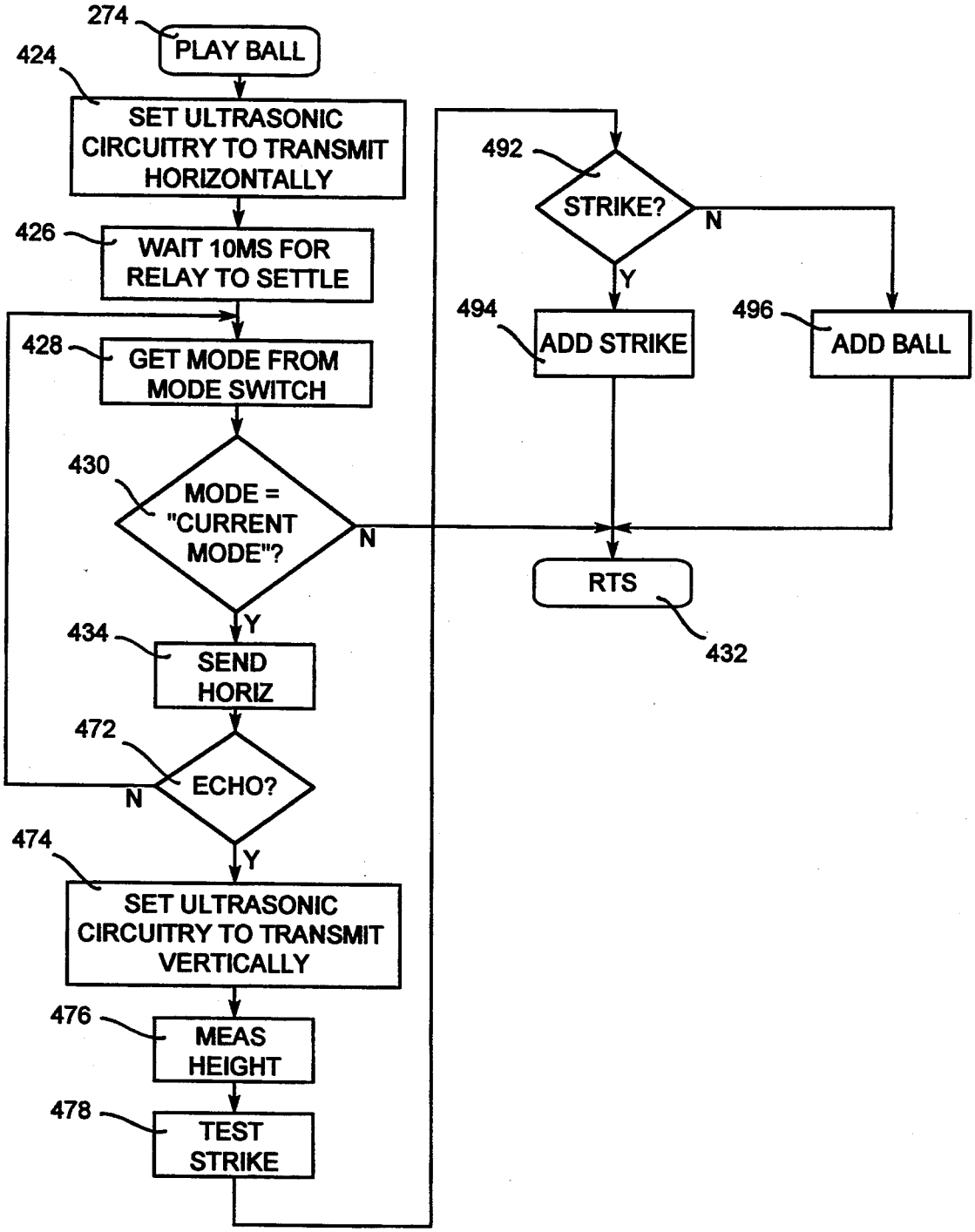

In FIG. 14, subroutine 274 first sets up the ultrasonic circuitry to transmit pulses horizontally, towards the source of the pitch, at Step 424. After a ten millisecond delay to allow the relay to settle at Step 426, the mode switch is checked at Step 428 to determine if it has moved off of the "Run" position. If it is determined at Step 430 that the mode switch has moved, the subroutine aborts and returns to the routine that called it at Step 432.

Assuming that the mode switch is still in the current mode, the SEND HORIZ subroutine is called at Step 434. The purpose of the SEND HORIZ subroutine is to transmit a train of pulses, receive an echo, and determine whether the pitched ball is within the upper and lower boundaries of the strike zone.

SEND HORIZ ROUTINE

Figure 15:
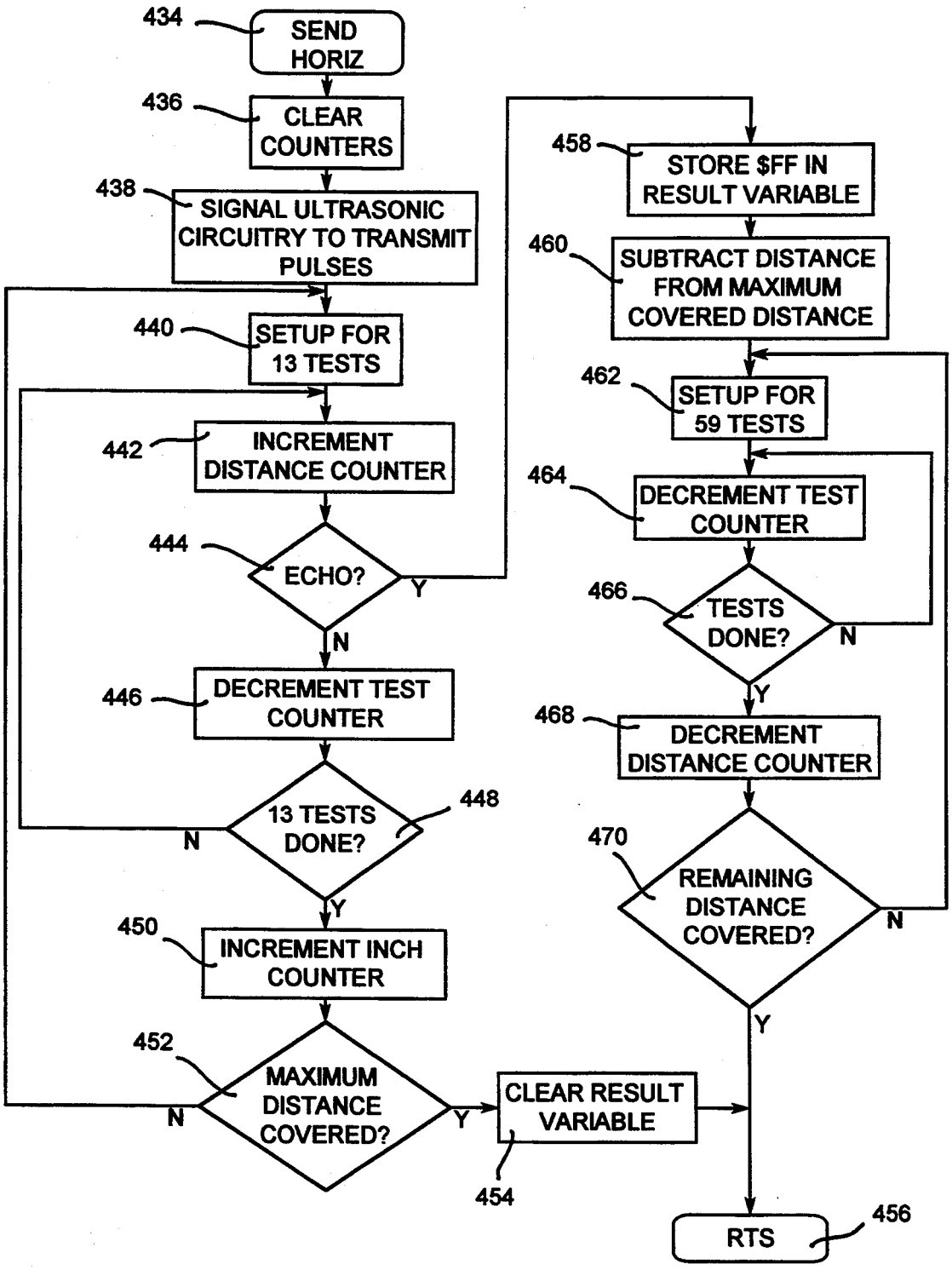

Referring to FIG. 15, subroutine 434 is designed to always take a specific amount of time to execute, whether or not an echo is received. To accomplish this, subroutine 434 waits for an echo for a certain amount of time. If no echo is received, the SEND HORIZ routine will eventually time out and return. If an echo is received, routine 434 will record the distance of the echo and will then wait for an amount of time that is equal to what would have passed if no echo had been detected.

In FIG. 15, the counters are first cleared at Step 436 and the ultrasonic circuitry is set at Step 438 to transmit horizontally. At Step 444, the routine tests for an echo 13 times for every inch of distance between indicator 10 and an object. Thus, the counter is set for a set of 13 tests. The routine then increments the object distance counter at Step 442 and looks for an echo at Step 444. If no echo is received, the number of remaining tests is decremented at Step 446. If all 13 tests have been performed as determined by Step 448, the inch counter is incremented at Step 450 and the routine sets up for another set of 13 tests. The inch counter records the amount of distance in front of the plate that has been searched thus far. Once the maximum distance is reached without an echo as determined at Step 452, the result variable MASK is cleared at Step 454 and the routine returns at Step 456.

If the ultrasonic circuitry detects an echo at Step 444, a value of 255 is put into the MASK variable at Step 458 and the routine begins to wait. The amount of time that the routine waits depends upon how long the echo took to return to the plate. A quick echo will cause a long wait afterward, while a late echo will cause a shorter wait afterward. At Step 460, the routine subtracts the amount of distance covered from the maximum distance. The result is effectively the number of inches between the object causing the echo in the maximum distance that the ultrasonic circuit will detect.

When the routine is not checking the ultrasonic circuitry for an echo, it performs 59 test loops at Step 462 for every inch of distance covered. Therefore, after the remaining distance is calculated, the routine sets up a counter of 459 loops. The routine keeps decrementing this counter at Step 464 until it reaches zero, as determined at Step 466. Once the tests are finished, the distance counter is decremented at Step 468 and then a determination is made at Step 470 whether the remaining distance has been covered. If the answer is No, the program loops back to Step 462. If the answer is Yes at Step 470, the routine returns to the subroutine that called it at Step 456.

Referring back to FIG. 14, once an echo has been received by the horizontal transducers as determined in Step 472, the detection circuitry is readied to determine whether the incoming pitch that has been detected is within the stored strike zone. To make this determination, the ultrasonic circuitry is set to transmit vertically at Step 474. The MEASURE HEIGHT routine is then called at Step 476, and proceeds as discussed above in connection with FIG. 11. After the measure height routine returns, the TEST STRIKE routine is called at Step 478. The TEST STRIKE routine is depicted in FIG. 16.

TEST STRIKE ROUTINE

Figure 16:
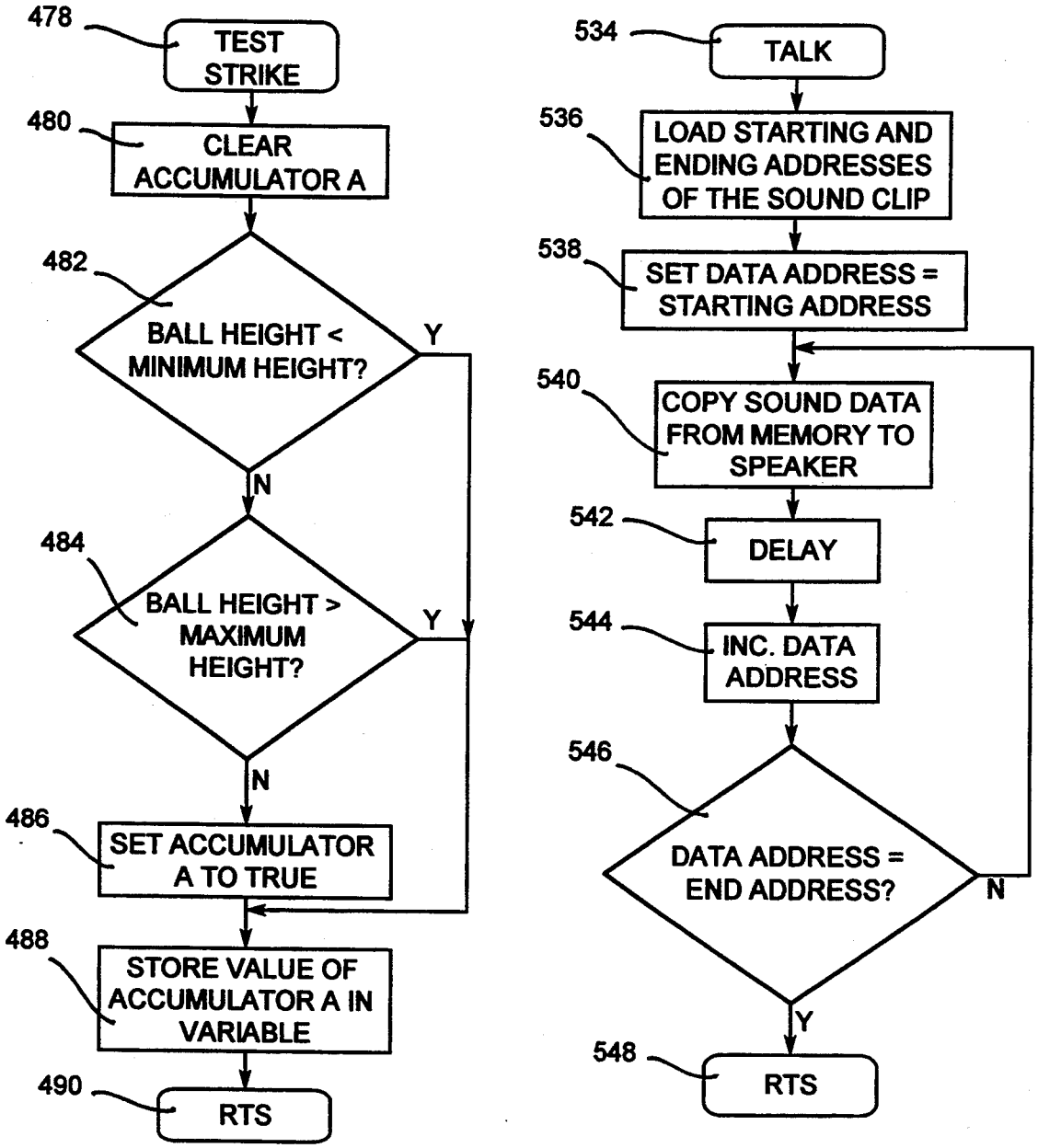

Referring to FIG. 16, the TEST STRIKE routine determines if a pitch is between the upper and lower boundaries of the strike zone. The first step of this routine is to clear Accumulator A at Step 480. The routine then determines if the ball is below the lower boundary of the strike zone at Step 482. If the distance between the ball and the device is greater than a stored distance value, a determination is made at Step 484 whether the distance between the device and the ball is less than the upper boundary. If the answer to Step 484 is No, the routine sets Accumulator A to 255 at Step 486. If the ball is found to be below the lower boundary or above the upper boundary, the routine does not alter the contents of Accumulator A. At Step 488, the routine copies Accumulator A into the result variable and returns at Step 490.

ADD STRIKE ROUTINE

Referring again to FIG. 14, once the TEST STRIKE routine returns, a determination is made at Step 492 whether the pitched ball was a strike. If so, the ADD STRIKE routine is called at Step 494 to increment the strike portion of the ball/strike count. If the pitched ball was not a strike, the ADD BALL subroutine is called at Step 496 to increment the ball portion of the ball/strike count.

Figure 17:
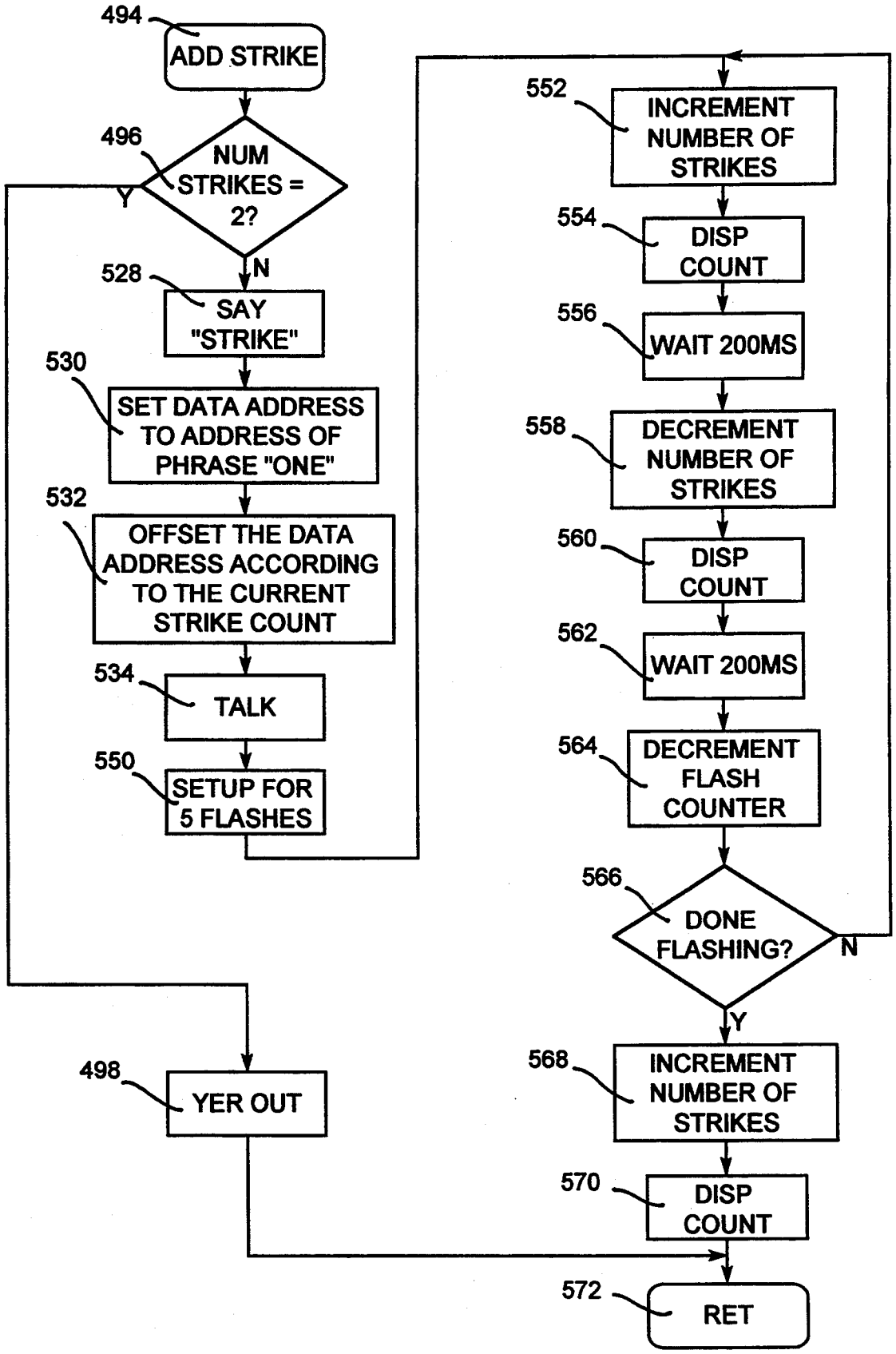
Figure 18:
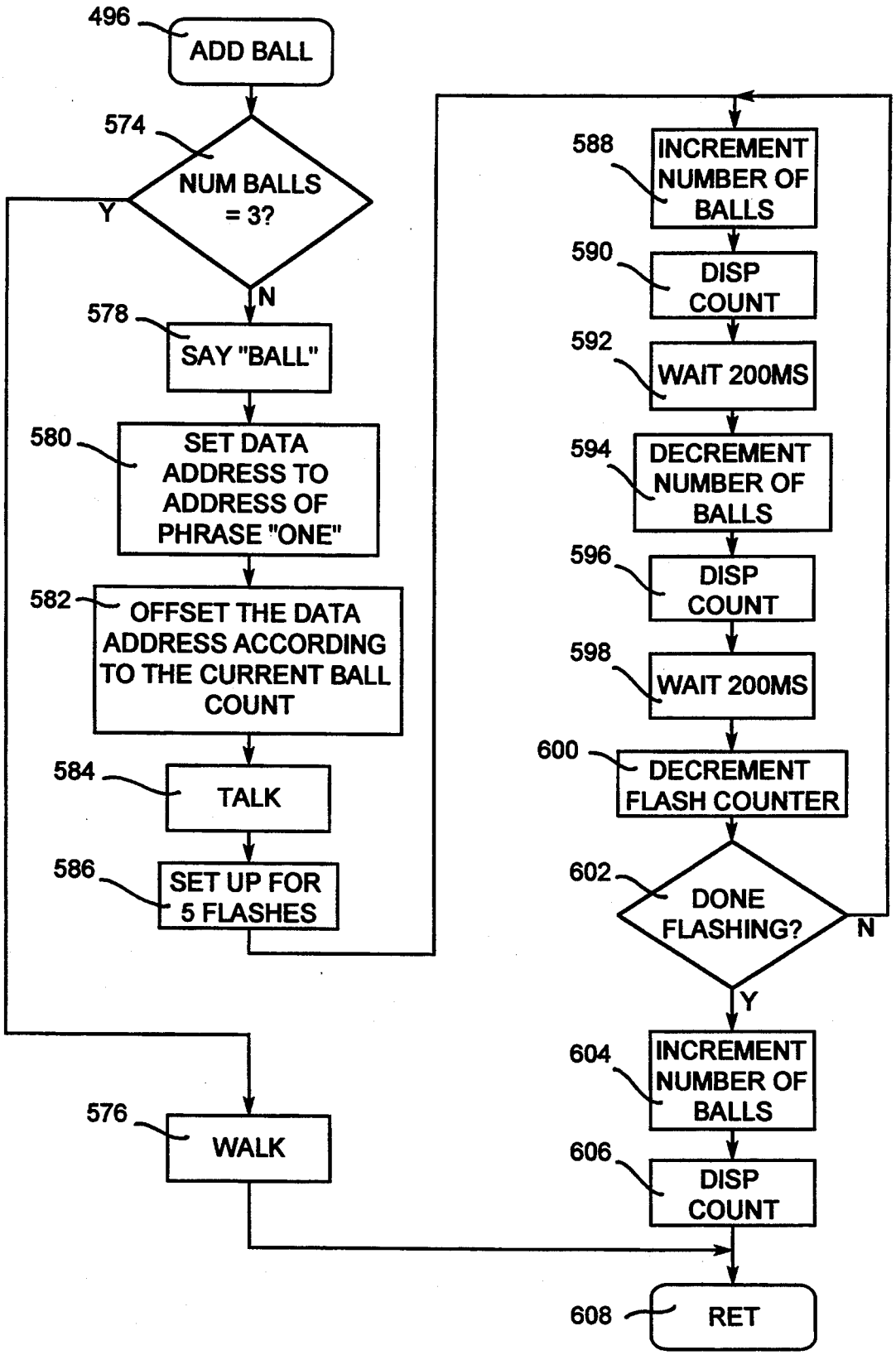

The ADD STRIKE routine is depicted in FIG. 17. The ADD BALL routine is depicted in FIG. 18. These two routines are substantially the same except for the number in the count that is affected. When a pitch is added to the count, an audible signal is provided and the corresponding LED blinks before turning on steady. For example, the third green LED is turned on for the third ball, the first red LED is turned on for the first strike, etc. If a walk or a strike out occurs because of the pitch, the appropriate routine is called.

Referring to ADD STRIKE routine 494 in FIG. 17, the routine first determines at Step 496 whether the number of strikes thus far is equal to two. If the answer is Yes, the YER OUT subroutine is called at Step 498.

YER OUT AND STRIKE FLASH ROUTINES

Figure 20:
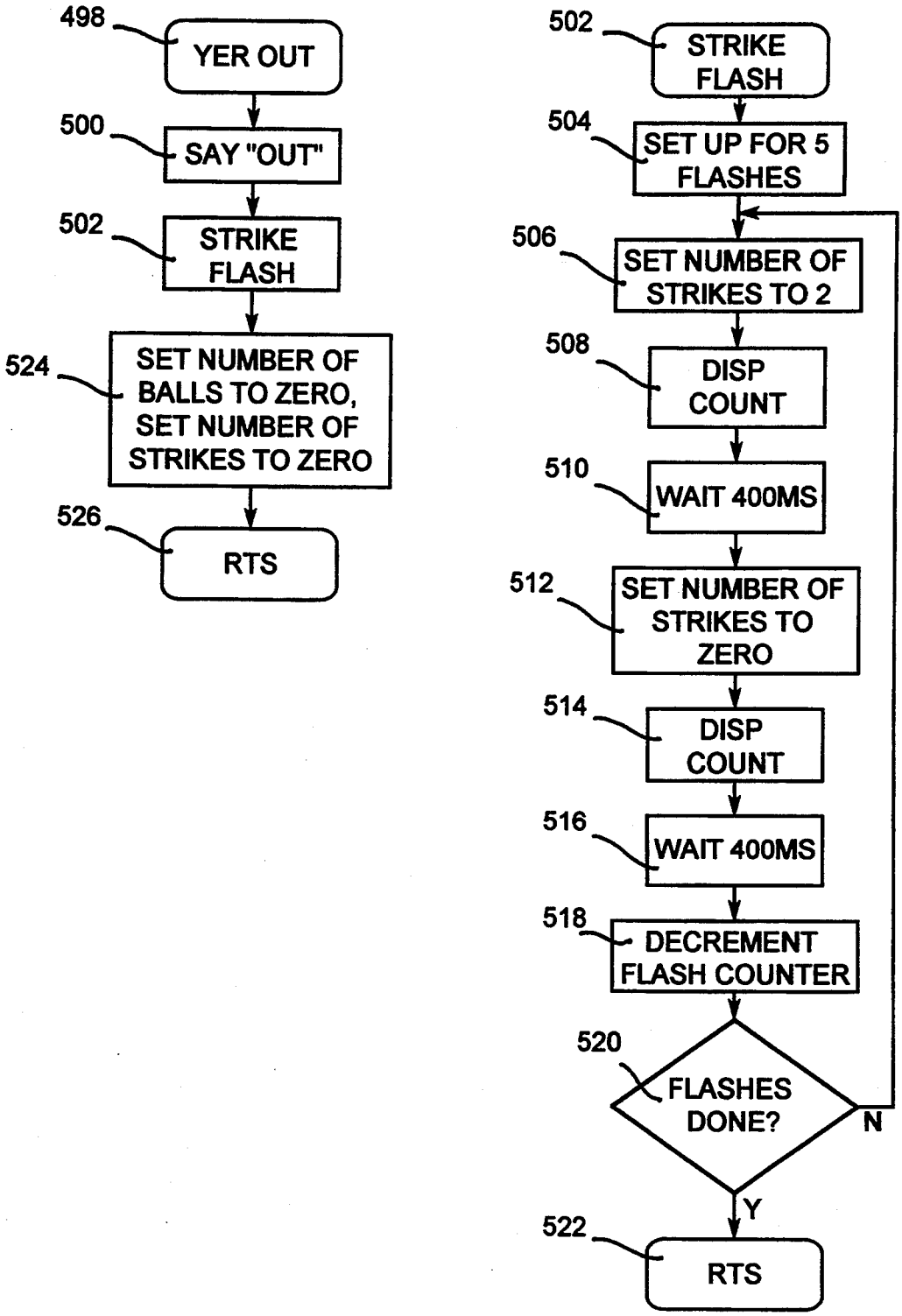

The YER OUT subroutine is depicted in FIG. 20. In FIG. 20, the word "out" is audibly output at Step 500. Then the STRIKE FLASH subroutine is called at Step 502. The STRIKE FLASH routine is also depicted in FIG. 20. In FIG. 20, the STRIKE FLASH routine flashes both of the strike LEDs in a manner very similar to that used in the ADD STRIKE and ADD BALL routines. First, the routine sets up for five flashes at Step 504. The routine then sets the number of strikes to two at Step 506 and updates the count on the LEDs by calling the DISP COUNT subroutine at Step 508. After the DISP COUNT subroutine returns, the STRIKE FLASH routine waits 400 milliseconds at Step 510. The number of strikes is then set to zero at Step 512 and the count is once again updated on the LEDs by calling the DISP COUNT subroutine at Step 514. Another 400 millisecond delay is imposed at Step 516, with the flash counter being thereafter decremented at Step 518. This process is repeated until all five flashes are done, as determined at Step 520. The routine then returns at Step 522.

Referring to the "YER OUT" routine in FIG. 20, after the STRIKE FLASH routine returns, the number of balls is set to zero, and the number of strikes is set to zero at Step 524. The subroutine then returns to the routine that called it at Step 526.

ADD STRIKE ROUTINE

Returning again to the ADD STRIKE routine in FIG. 17, if no strike out is determined at Step 496, the word "strike" is audibly output at Step 528. The routine then announces which ball or strike has just occurred. This is accomplished by placing the location of the addresses for the word "one" into the X-index register at Step 530. This location is then offset at Step 532 by the current number of balls or strikes. This offset location is then used by the TALK routine to speak the correct number at Step 534.

TALK ROUTINE

The TALK routine is depicted In FIG. 16. When the TALK routine is called, it first copies the ending address of the phrase into the Y-index register, and the starting address of the phrase into the X-index register at Step 536. A data address is used to keep track of the progress of the routine. The data address is initialized to the starting address of the phrase at Step 538. For each memory location between the beginning and ending addresses of the phrase, the routine copies a byte of data from memory to the external eight-bit latch which is connected to the speaker, at Step 540. As with the latches for the seven-segment displays, the speaker latch is addressed as if it were any other memory location. After each byte of data is copied to the speaker, the routine waits for a moment at Step 542 to insure that the data is being transmitted at the proper rate. When the sounds are stored in the speaker memory, they are sampled at a rate of 12,000 samples per second. Therefore, the delay after each byte of data is approximately 1/12,000 seconds. After this delay, the data address is incremented at Step 544 for the next byte of data. When the data address is equal to the ending address, as determined at Step 546, the routine is finished and returns at Step 548.

Referring again to FIG. 17, once the talk routine returns, the system is set up at Step 550 to flash the LEDs. The number of strikes is incremented at Step 552, and the DISP COUNT subroutine is called at Step 554. After the DISP COUNT subroutine returns, a 200 millisecond wait is imposed at Step 556. The number of strikes is thereafter incremented at Step 558 and the DISP COUNT subroutine is again called at Step 560. Another 200 millisecond wait is imposed at Step 562, and the flash counter is decremented at Step 564. A determination is made at Step 566 whether five flashes have occurred. If not, the count is again incremented at Step 552. If the answer is Yes at Step 556, the number of strikes is incremented at Step 568 and the DISP COUNT subroutine is again called at Step 570. The routine returns to the routine that called it at Step 572.

ADD BALL ROUTINE

The ADD BALL routine that is called by the PLAY BALL routine is depicted in FIG. 18. In FIG. 18, a determination is made at Step 574 whether the number of balls in the count is currently equal to three. If the answer is Yes, the next ball will yield a walk, and the WALK subroutine is called at Step 576. The WALK routine is depicted in FIG. 21.

If the answer at Step 574 is No, a verbal output of the word "ball" is spoken at Step 578. As in the ADD STRIKE routine described above, the ADD BALL routine then announces which ball has just occurred. This is done by placing the location of the addresses for the word "one" in the X-index register at Step 580. This location is then offset by the current number of balls at Step 582. The TALK routine, described above in connection with FIG. 16, is then called at Step 584. When the TALK routine returns, the system is set up for five flashes at Step 586. The number of balls is then incremented at Step 588, and the DISP COUNT routine is called at Step 590. A 200 millisecond delay is imposed at Step 592 after the DISP COUNT routine returns. The number of balls is then decremented at Step 594, so that to the users it appears that the LED is flashing. The DISP COUNT subroutine is again called at Step 596 and another 200 millisecond wait is imposed at Step 598. The flash counter is again decremented at Step 600, and a test is made at Step 602 to determine whether all five flashes have occurred. After all five flashes have occurred, the count is finally incremented to its correct value at Step 604, and the new count is displayed on the LEDs by calling the DISP COUNT routine at Step 606. The ADD BALL routine then returns to the routine that called at Step 608.

WALK ROUTINE

Figure 21:
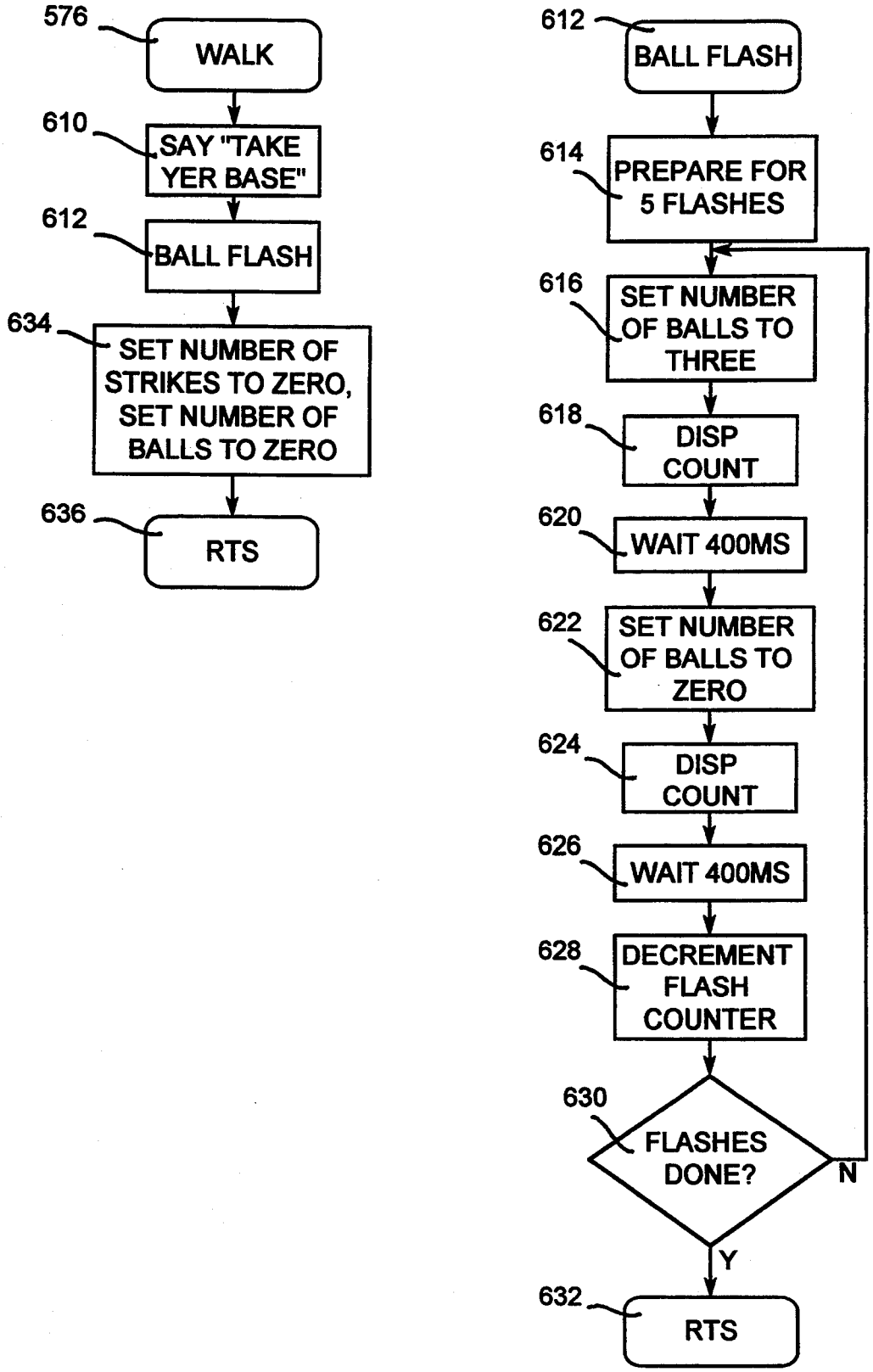

The WALK routine that is called by the ADD BALL routine (FIG. 18) is depicted in FIG. 21. In FIG. 21, the first step of the WALK routine is to audibly output a phrase such as "Take Yer Base" at Step 610 using the TALK routine. At Step 612, the BALL FLASH routine is called to flash the three green ball LEDs.

BALL FLASH ROUTINE

The BALL FLASH routine is also depicted in FIG. 21. The purpose of this routine is to flash all of the "ball" LEDs in a manner very similar to that used in the ADD STRIKE and ADD BALL routines. The first step of the BALL FLASH routine is to set up the system for five flashes at Step 614. This routine accomplishes the flashing by alternating the number of balls between three and zero.

At Step 616, the number of balls is set to three. The DISP COUNT routine is then called at Step 618. A 400 ms wait is imposed at Step 620, and then the number of balls is set to zero at Step 622. The DISP COUNT subroutine is then called again at Step 624, and another 400 ms wait is imposed at Step 626. The flash counter is decremented at Step 628, and a test is made at Step 630 to determine whether all five flashes have occurred. If not, the routine loops back. When all five flashes have occurred, the BALL FLASH routine returns at Step 632. Once the BALL FLASH routine has returned to the WALK routine (FIG. 21), the number of balls and the number of strikes in the ball/strike count are reset to zero at Step 634. The WALK routine then returns to the subroutine that called it at Step 636.

DISPLAY ROUTINE

Several subroutines described herein refer to the displaying of letters or patterns on the two seven-segment LED displays. The hardware used to accomplish the displaying of letters or patterns includes an eight-bit latch connected to each of the seven-segment LED displays. Seven of the outputs from each latch correspond to segments in the display. The data for each phrase or pattern to be displayed are contained in a table in the microprocessor memory. The table is set up in such a way that "ones" in the table correspond to "on" segments, while "zeros" in the data table correspond to "off" segments. When a message is to be placed on these displays, the program loads the address of the particular phrase or pattern into the X-index register and calls the DISPLAY routine.

The first step of DISPLAY routine 638 is to obtain the byte of information whose address is in the X-index at Step 640 and to copy the data to the latch for the seven-segment display at Step 642. The next byte of information is then obtained at Step 644 and copied at Step 646 to the latch corresponding to the right seven-segment display. The subroutine returns at Step 648.

PRACTICE ROUTINE

Figure 19:
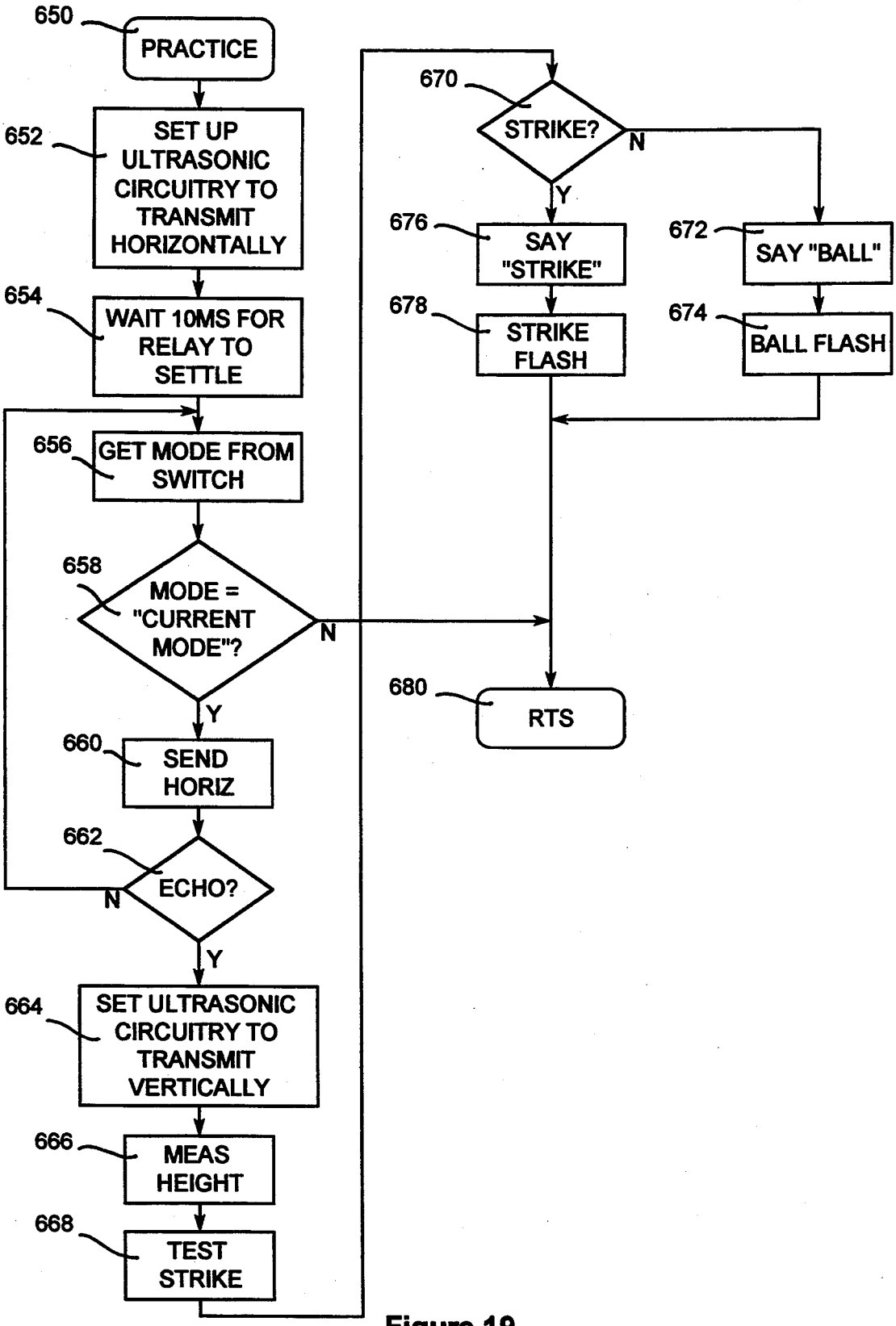

As described above, one of the modes in which the device may be set is the "Practice" mode. The software routine corresponding to the Practice mode is depicted in FIG. 19. In FIG. 19, Practice routine 650 is substantially the same as the RUN routine described above except that the number of balls and strikes is not updated. The PRACTICE routine uses the same combination of horizontal and vertical pulses to detect a pitch and to determine if it is a ball or strike. Once this determination has been made, the routine verbally announces the pitch as a strike or a ball and calls the STRIKE FLASH routine or the BALL FLASH routine, whichever is appropriate. Once the LEDs have been flashed, the PRACTICE ROUTINE returns.

More specifically, at Step 652 in the PRACTICE routine, the ultrasonic circuitry is set up to transmit horizontally. A ten millisecond delay is imposed at Step 654 to allow the relay to settle. The current setting of the mode is obtained from the mode switch at Step 656. At Step 658, a determination is made whether the present setting of the mode still corresponds to the Practice mode. If not, the subroutine aborts. If the mode has not been changed, the SEND HORIZ subroutine is called at Step 660 so that the ultrasonic pulses may be transmitted to detect an incoming pitch.

Once routine 660 returns, a determination is made at Step 662 whether an echo or a reflected signal has been located. If not, the PRACTICE routine loops back. If an echo signal has been received, this indicates that an incoming pitch has been detected. At Step 664, the ultrasonic circuitry is then set to transmit vertically to determine whether the pitch is in the strike zone. The MEAS HEIGHT subroutine is then called at Step 666, followed by the TEST STRIKE subroutine at Step 668.

At Step 670, a determination is made whether the pitch was a strike. If the pitch was not a strike, the word "ball" is output at Step 672 and the BALL FLASH routine is called at Step 674.

If the pitch was determined to be a strike at Step 670, the word "strike" is spoken at Step 676, and the STRIKE FLASH routine is called at Step 678. The PRACTICE routine then returns to the subroutine that called it at Step 680.

While a preferred embodiment of the present invention has been shown and described, alternate embodiments will be apparent to those skilled in the art and are within the intended scope of the present invention. Therefore, the invention is to be limited only to the following claims.

We claim:

1. An apparatus used in a baseball game that determines whether a ball is within a baseball strike zone, said strike zone having right, left, upper and lower boundaries, said baseball game also using a home plate, comprising:

means for detecting whether a ball is approaching said strike zone;

first means for determining whether said ball is between the right and left boundaries of said strike zone;

second means for determining whether said ball is between the upper and lower boundaries of said strike zone;

indicator means for indicating whether said ball has passed through a portion of said strike zone; and a housing;

wherein said detecting means, said first determining means, and said second determining means are all disposed in said housing and wherein said housing is also said home plate.

2. The apparatus of claim 1, further comprising:

means for counting the number of times that a detected ball is determined by said first and second determining means to be within said strike zone.

3. The apparatus of claim 2, further comprising:

means for counting the number of times that a detected ball is determined to be outside of said strike zone.

4. The apparatus of claim 1, further comprising:

means for changing the boundaries of said strike zone.

5. The apparatus of claim 1, further comprising:

means for initially setting the upper and lower boundaries of said strike zone.

6. The apparatus of claim 5, wherein said setting means includes:

means for emitting a signal toward an object when said object is in a first position;

means for receiving a reflected signal after said object has been struck by said emitted signal;

means for calculating a distance value functionally related to the distance between said emitting means and said object; and means for storing a value functionally related to said distance value.

7. The apparatus of claim 6, wherein said distance value is functionally related to the lower boundary of said strike zone, and wherein said setting means further comprises:

means for emitting a second signal toward said object when said object is in a second position;

means for receiving a second reflected signal after said object in said second position has been struck by said second emitted signal;

means for calculating a second distance value functionally related to the distance between said second signal emitting means and the second position of said object; and means for storing a value functionally related to said second distance value, said second distance value corresponding to the upper boundary of said strike zone.

8. The apparatus of claim 1, wherein said detecting means includes:

means for emitting a signal in a direction from which said ball is expected to originate; and means for receiving a reflected signal after said emitted signal has struck said ball.

9. The apparatus of claim 8, further comprising:

means for enabling said first determining means or said second determining means if said reflected signal is received by said receiving means.

10. The apparatus of claim 8, wherein said emitting means includes a transducer interconnected with a surface of said housing that faces said direction.

11. The apparatus of claim 10, wherein said transducer is an ultrasonic transducer.

12. The apparatus of claim 1, wherein said first determining means includes:

means for emitting at least one signal toward said ball; and means for receiving a reflected signal if said ball is between said right and left boundaries.

13. The apparatus of claim 12, wherein said emitting means includes at least one transducer interconnected with an upper surface of said housing.

14. The apparatus of claim 13, wherein said transducer is an ultrasonic transducer.

15. The apparatus of claim 1, wherein said second determining means includes:

means for emitting at least one signal toward said ball; and means for receiving a reflected signal if said ball is between said lower and said upper boundaries.

16. The apparatus of claim 15, wherein said emitting means includes at least one transducer interconnected with an upper surface of said housing.

17. The apparatus of claim 16, wherein said transducer is an ultrasonic transducer.

18. The apparatus of claim 1, wherein said indicator means includes:

at least one strike light that is illuminated when said ball is determined to have been within said strike zone; and at least one ball light that is illuminated when said ball did not pass through said strike zone.

19. The apparatus of claim 18, wherein said at least one strike light and said at least one ball light include a plurality of lights which are illuminated to indicate a baseball ball and strike count for a particular player.

20. The apparatus of claim 19, further comprising:

means for manually changing said ball and strike count for said player.

21. The apparatus of claim 1, wherein said indicator means includes:

means for generating an audible sound when said ball passes through a portion of said strike zone.

22. The apparatus of claim 1, wherein said housing is substantially shaped like a baseball home plate.

23. An apparatus used in a baseball game that determines whether a ball is within a baseball strike zone, said strike zone having right, left, upper and lower boundaries, said baseball game also using a home plate, comprising:

a first sensor circuit that detects whether a ball is approaching the strike zone;

a second sensor circuit that determines whether the ball is between the right and left boundaries of said strike zone, and that determines whether the ball is between the upper and lower boundaries of said strike zone;

an indicator that indicates whether the ball has passed through any portion of said strike zone; and a housing that substantially encloses said first and second sensor circuits and that is also used as said home plate.

24. The apparatus of claim 23, wherein each of said sensor circuits includes at least one sensor that emits a signal and that receives a reflected signal if said emitted signal strikes said ball.

25. The apparatus of claim 23, further comprising:

means for changing at least one of the boundaries of said strike zone.

26. The apparatus of claim 23, further comprising:

means for selecting and storing values corresponding to the upper and lower boundaries of said strike zone.

27. The apparatus of claim 23, wherein said housing is substantially shaped like a baseball home plate.

28. The apparatus of claim 23, wherein all of the components of the apparatus are enclosed within said housing.

* * * * *